US009782987B2

(12) United States Patent
Takagi

(10) Patent No.: US 9,782,987 B2
(45) Date of Patent: Oct. 10, 2017

(54) IMAGE FORMING APPARATUS, INFORMATION PROCESSING DEVICE, AND IMAGE FORMING METHOD

(71) Applicant: Yasunobu Takagi, Kanagawa (JP)

(72) Inventor: Yasunobu Takagi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/876,385

(22) Filed: Oct. 6, 2015

(65) Prior Publication Data

US 2016/0101630 A1 Apr. 14, 2016

(30) Foreign Application Priority Data

Oct. 8, 2014 (JP) ..... 2014-207346

(51) Int. Cl.
*B41J 2/21* (2006.01)
*B41J 19/14* (2006.01)

(52) U.S. Cl.
CPC ..... *B41J 19/147* (2013.01); *B41J 2/2103* (2013.01); *B41J 2/2132* (2013.01)

(58) Field of Classification Search
CPC .. B41J 2/2132; B41J 2/04563; B41J 2/04581; B41J 2/15; B41J 29/38
See application file for complete search history.

(56) References Cited

U.S. PATENT DOCUMENTS 4,593,295 A * 6/1986 Matsufuji ..... B41J 2/2103 347/41
6,325,489 B2 * 12/2001 Endo ..... B41J 2/15 347/40
6,883,898 B2 * 4/2005 Sato ..... B41J 2/15 347/40
7,465,008 B2 * 12/2008 Nunokawa ..... B41J 2/2103 347/15
7,806,497 B2 * 10/2010 Mitsuzawa ..... B41J 2/2132 347/12
8,498,020 B2 * 7/2013 Hirano ..... B41J 2/04563 347/43

(Continued)

FOREIGN PATENT DOCUMENTS

JP 2001-130033 5/2001
JP 2007-136889 6/2007

(Continued)

*Primary Examiner* — Stephen Meier
*Assistant Examiner* — John P Zimmermann
(74) *Attorney, Agent, or Firm* — Cooper & Dunham LLP

(57) ABSTRACT

An image forming apparatus includes an image forming unit having at least two nozzle lines each having multiple nozzles to discharge different color droplets; a carriage that carries the image forming unit and is configured to reciprocate in the moving direction crossing an arrangement direction of the nozzles; and a control device to control dual-directional printing to form an image using the at least two nozzle lines in an outward and a return of the carriage. The control device executes color difference handling print control for discharging the different color droplets by using, of each of the nozzles in the at least two nozzle lines, the nozzles located at different positions in the arrangement direction of the nozzles while not overlapping in the moving direction of the carriage.

20 Claims, 20 Drawing Sheets

(56) References Cited

U.S. PATENT DOCUMENTS

| | | | | |
|---|---|---|---|---|
| 8,814,325 | B2 * | 8/2014 | Furuta | B41J 2/15 347/43 |
| 9,056,457 | B2 * | 6/2015 | Hasegawa | B41J 2/04505 |
| 2002/0021319 | A1 * | 2/2002 | Kawatoko | B41J 2/2132 347/15 |
| 2007/0085869 | A1 | 4/2007 | Hirano et al. | |
| 2009/0051734 | A1 * | 2/2009 | Ike | B41J 2/2107 347/43 |

FOREIGN PATENT DOCUMENTS

| | | |
|---|---|---|
| JP | 2007-137049 | 6/2007 |
| JP | 2011-084005 | 4/2011 |

* cited by examiner

FIG. 5A
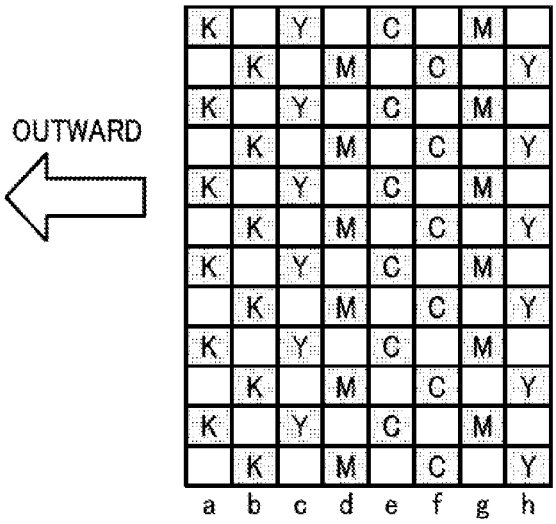
FIG. 5B
| FIRST | LANDING SEQUENCE | | | LAST |
|---|---|---|---|---|
| | K | Y | C | M |
| | K | M | C | Y |
| | K | Y | C | M |
| | K | M | C | Y |
| | K | Y | C | M |
| | K | M | C | Y |
| | K | Y | C | M |
| | K | M | C | Y |
| | K | Y | C | M |
| | K | M | C | Y |
| | K | Y | C | M |
| | K | M | C | Y |
FIG. 5C
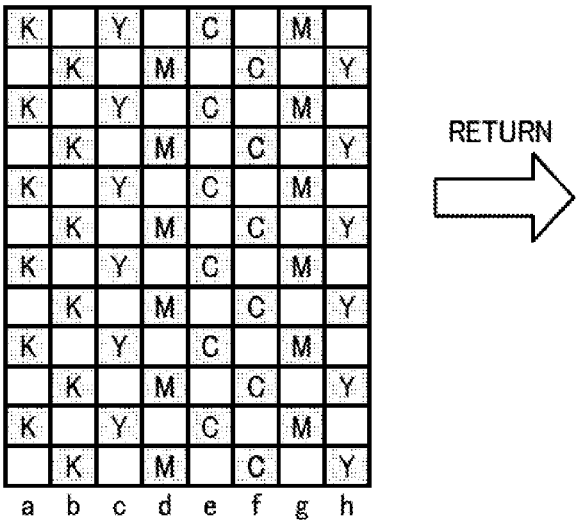
FIG. 5D
| FIRST | LANDING SEQUENCE | | | LAST |
|---|---|---|---|---|
| | M | C | Y | K |
| | Y | C | M | K |
| | M | C | Y | K |
| | Y | C | M | K |
| | M | C | Y | K |
| | Y | C | M | K |
| | M | C | Y | K |
| | Y | C | M | K |
| | M | C | Y | K |
| | Y | C | M | K |
| | M | C | Y | K |
| | Y | C | M | K |

FIG. 12A
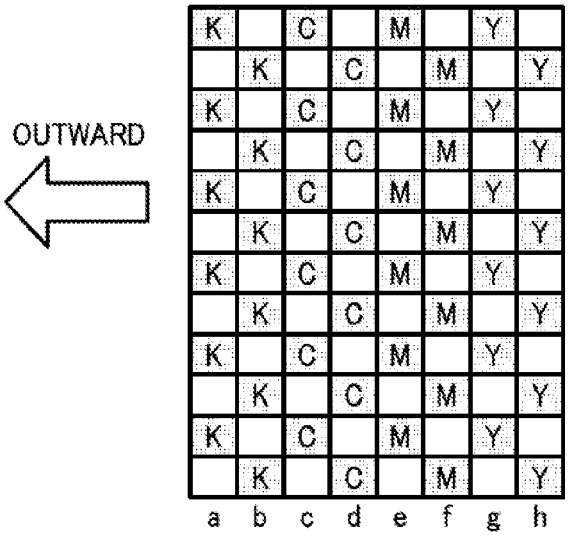
FIG. 12B
| FIRST | LANDING SEQUENCE | | | LAST |
|---|---|---|---|---|
| | K | C | M | Y |
| | K | C | M | Y |
| | K | C | M | Y |
| | K | C | M | Y |
| | K | C | M | Y |
| | K | C | M | Y |
| | K | C | M | Y |
| | K | C | M | Y |
| | K | C | M | Y |
| | K | C | M | Y |
| | K | C | M | Y |
| | K | C | M | Y |
FIG. 12C
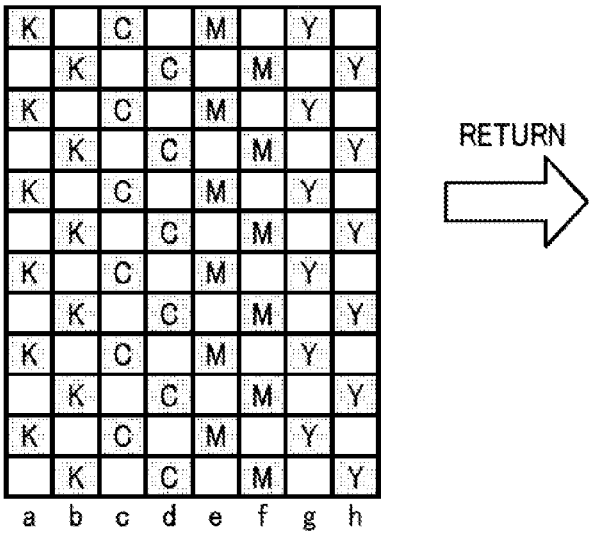
FIG. 12D
| FIRST | LANDING SEQUENCE | | | LAST |
|---|---|---|---|---|
| | Y | M | C | K |
| | Y | M | C | K |
| | Y | M | C | K |
| | Y | M | C | K |
| | Y | M | C | K |
| | Y | M | C | K |
| | Y | M | C | K |
| | Y | M | C | K |
| | Y | M | C | K |
| | Y | M | C | K |
| | Y | M | C | K |
| | Y | M | C | K |

FIG. 15

| R | G | B | K | C | M | Y | COLOR DIFFERENCE HANDLING |
|---|---|---|---|---|---|---|---|
| 0 | 0 | 0 | 255 | 64 | 64 | 64 | YES |
| 8 | 8 | 8 | 248 | 60 | 60 | 60 | YES |
| 16 | 16 | 16 | 240 | 56 | 56 | 56 | YES |
| 24 | 24 | 24 | 232 | 52 | 52 | 52 | YES |
| • | • | • | • | • | • | • | • |
| • | • | • | • | • | • | • | • |
| 192 | 192 | 192 | 8 | 64 | 64 | 64 | YES |
| • | • | • | • | • | • | • | • |
| • | • | • | • | • | • | • | • |
| 240 | 240 | 240 | 0 | 16 | 16 | 16 | NO |
| 248 | 248 | 248 | 0 | 8 | 8 | 8 | NO |
| 255 | 255 | 255 | 0 | 0 | 0 | 0 | NO |
| • | • | • | • | • | • | • | • |
| • | • | • | • | • | • | • | • |
| • | • | • | • | • | • | • | • |

FIG. 16

| R | G | B | K | C | M | Y | COLOR DIFFERENCE | COLOR DIFFERENCE HANDLING |
|---|---|---|---|---|---|---|---|---|
| 0 | 0 | 0 | 255 | 64 | 64 | 64 | INTOLERABLE | YES |
| 8 | 8 | 8 | 248 | 60 | 60 | 60 | INTOLERABLE | YES |
| 16 | 16 | 16 | 240 | 56 | 56 | 56 | INTOLERABLE | YES |
| 24 | 24 | 24 | 232 | 52 | 52 | 52 | INTOLERABLE | YES |
| • | • | • | • | • | • | • | • | • |
| • | • | • | • | • | • | • | • | • |
| 192 | 192 | 192 | 8 | 64 | 64 | 64 | TOLERABLE | NO |
| • | • | • | • | • | • | • | • | • |
| • | • | • | • | • | • | • | • | • |
| 240 | 240 | 240 | 0 | 16 | 16 | 16 | TOLERABLE | NO |
| 248 | 248 | 248 | 0 | 8 | 8 | 8 | TOLERABLE | NO |
| 255 | 255 | 255 | 0 | 0 | 0 | 0 | TOLERABLE | NO |
| • | • | • | • | • | • | • | • | • |
| • | • | • | • | • | • | • | • | • |
| • | • | • | • | • | • | • | • | • |

FIG. 18A
OUTWARD
| | | | | | | | |
|---|---|---|---|---|---|---|---|
| K | | × | | × | | × | |
| | × | | M | | C | | Y |
| K | | × | | M | | × | |
| | × | | M | | C | | Y |
| K | | × | | × | | × | |
| | × | | M | | C | | Y |
| K | | × | | × | | × | |
| | × | | M | | C | | Y |
| K | | × | | × | | × | |
| | × | | M | | C | | Y |
| K | | × | | × | | × | |
| | × | | M | | C | | Y |
| K | | × | | × | | × | |
| | × | | × | | C | | Y |
FIG. 18B
K
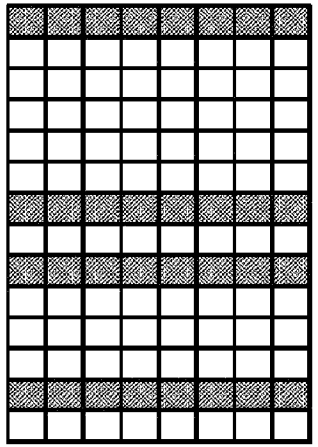
FIG. 18C
COLOR
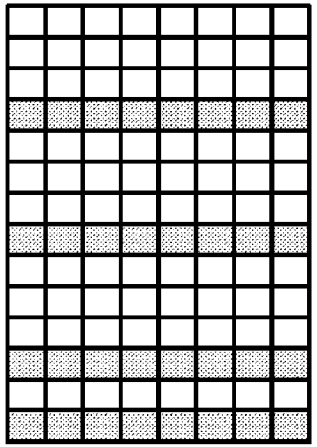
FIG. 18D
PRINT RESULT
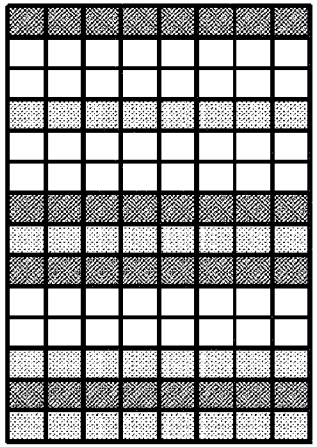
FIG. 18E
RETURN
| | | | | | | | |
|---|---|---|---|---|---|---|---|
| × | | Y | | C | | M | |
| | K | | × | | × | | × |
| × | | Y | | C | | M | |
| | K | | × | | × | | × |
| × | | Y | | C | | M | |
| | K | | × | | × | | × |
| × | | Y | | C | | M | |
| | K | | × | | × | | × |
| × | | Y | | C | | M | |
| | K | | × | | × | | × |
| × | | Y | | C | | M | |
| | K | | × | | × | | × |
| × | | Y | | C | | M | |
| | K | | × | | × | | × |
FIG. 18F
K
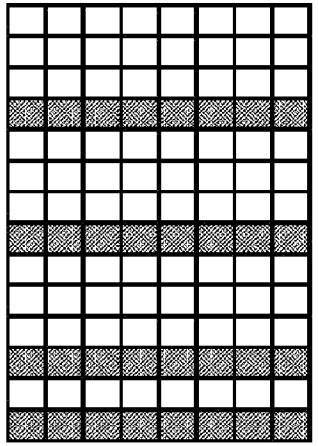
FIG. 18G
COLOR
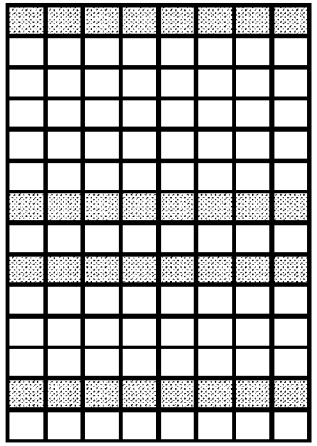
FIG. 18H
PRINT RESULT
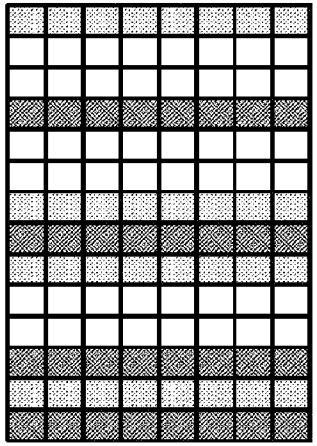

IMAGE FORMING APPARATUS, INFORMATION PROCESSING DEVICE, AND IMAGE FORMING METHOD

CROSS-REFERENCE TO RELATED APPLICATIONS

This patent application is based on and claims priority pursuant to 35 U.S.C. §119(a) to Japanese Patent Application No. 2014-207346, filed on Oct. 8, 2014 in the Japan Patent Office, the entire disclosure of which is hereby incorporated by reference herein.

BACKGROUND

Technical Field

The present invention relates to an image forming apparatus, an information processing device, and an image forming method.

Background Art

When a serial type image forming apparatus dual-directionally prints an image in both directions of an outward and a return of a carriage, the landing sequence of different color droplets is different in the outward and the return directions, thereby causing dual-directional color difference.

In an attempt to solve this problem, a recording head is provided which has multiple nozzles in a nozzle line discharging yellow ink shifted in a certain direction to the nozzles in a nozzle line discharging magenta ink and to the nozzles in a nozzle line discharge cyan ink.

By using a head having this arrangement, in which a yellow ink nozzle line is shifted in a certain direction to a magenta ink nozzle line and a cyan ink nozzle line, the color difference is reduced by shifting the color overlapping positions of two different colors.

However, since the color overlapping positions are shifted, the color shift may directly affect an image when forming a line or text.

SUMMARY

According to the present invention, provided is an improved image forming apparatus including an image forming unit having at least two nozzle lines each having multiple nozzles to discharge different color droplets; a carriage that carries the image forming unit and is configured to reciprocate in a direction crossing an arrangement direction of the nozzles; and a control device to control dual-directional printing to form an image using the at least two nozzle lines in an outward and a return of the carriage. The control device executes color difference handling print control for discharging the different color droplets by using, of each of the nozzles in the at least two nozzle lines, the nozzles located at different positions in the arrangement direction of the nozzles while not overlapping in the moving direction of the carriage.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIGS. 5A, 5B, 5C, and 5D are diagrams illustrating a reciprocating behavior and the landing sequence of droplets at each nozzle position for use in a description of the mechanism of how dual-directional printing occurs in the head configuration of the first embodiment;

FIGS. 12A, 12B, 12C, and 12D are diagrams illustrating a reciprocating behavior and the landing sequence of droplets at each nozzle position for use in a description of occurrence of dual-directional color difference in the same head configuration of the third embodiment;

FIG. 15 is a diagram illustrating an example of the table for use in a description of an eighth embodiment of the present disclosure;

FIG. 16 is a diagram illustrating another example of the table for use in a description of the eighth embodiment of the present disclosure;

FIGS. 18A, 18B, 18C, 18D, 18E, 18F, 18G, and 18H are diagrams for use in a description of a tenth embodiment of the present disclosure.

Figure 1:
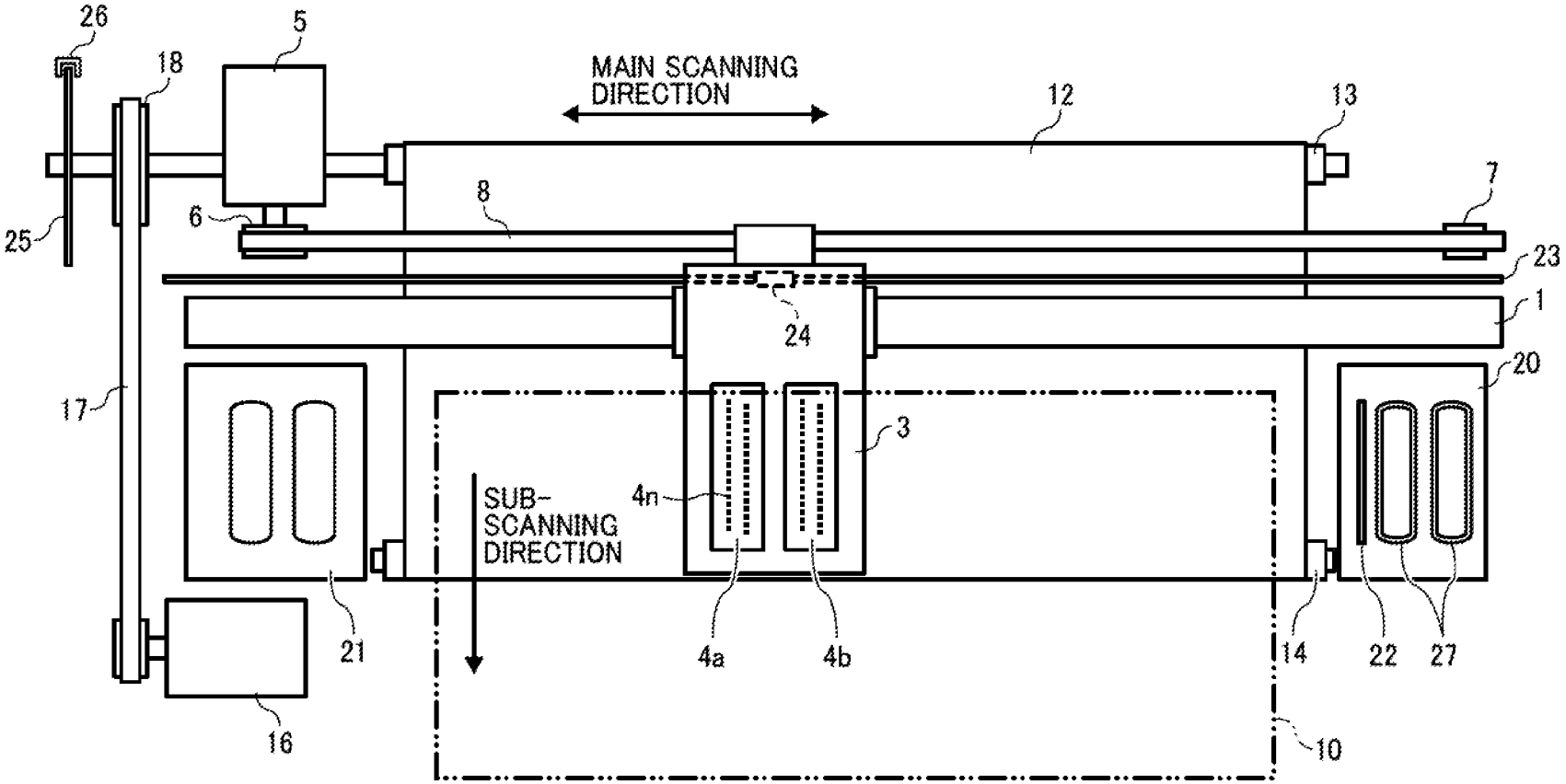
FIG. 1 is a plane view of a mechanism of an embodiment of the image forming apparatus of the present disclosure.

The accompanying drawings are intended to depict example embodiments of the present invention and should not be interpreted to limit the scope thereof The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

According to the present invention, provided is an improved image forming apparatus capable of executing dual-directional printing free of dual-directional color difference without using a liquid discharging head having a special nozzle arrangement.

The image forming apparatus includes an image forming unit having at least two nozzle lines each having multiple nozzles to discharge different color droplets; a carriage that carries the image forming unit and is configured to reciprocate in a direction crossing an arrangement direction of the nozzles; and a control device to control dual-directional printing to form an image using the at least two nozzle lines in an outward and a return of the carriage. The control device executes color difference handling print control for discharging the different color droplets by using, of each of the nozzles in the at least two nozzle lines, the nozzles located at different positions in the arrangement direction of the nozzles while not overlapping in the moving direction of the carriage.

Figure 2:
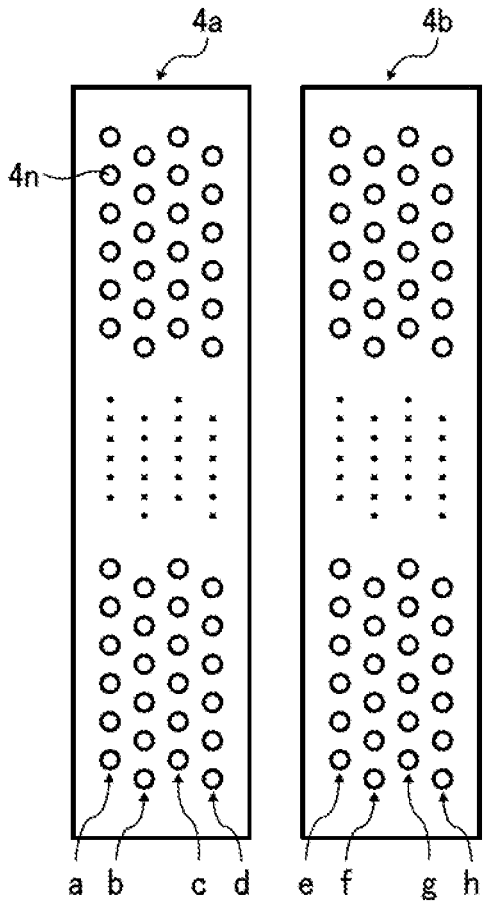
FIG. 2 is a plane view of heads having the same configuration.

Embodiments of the present disclosure are described with reference to the accompanying drawings. The image forming apparatus of the present disclosure is described using an example with reference to FIG. 1 and FIG. 2. FIG. 1 is a plane view of the mechanism of the image forming apparatus and FIG. 2 is a plane view for use in a description of the same head configuration as FIG. 1. Incidentally, the recording head illustrated in FIG. 2 is transmissively viewed from top.

This image forming apparatus is a serial type inkjet recording apparatus. A main guiding member 1 laterally bridged between sided plates on the right side and the left side and a subordinate guiding member support a carriage 3 in a movable way. A main scanning motor 5 drives the carriage 3 to reciprocate in the main scanning direction (carriage moving direction) via a timing belt 8 bridged between a drive pully 6 and a driven pully 7.

The carriage 3 includes recording heads 4*a* and 4*b* (referred to as recording head 4 if distinction thereof is not necessary) having liquid discharging heads as an image forming unit. The recording head 4 discharges color ink droplets of, for example, yellow (Y), cyan (C), magenta (M), and black (K).

As illustrated in FIG. 2, recording heads 4*a* and 4*b* respectively include four nozzle lines a, b, c, and d and e, f, g, and h, each having multiple nozzles 4*n*. Each combination of the nozzle lines a and b, c and d, e and f, and g and h is shifted in a zigzag manner in the nozzle arrangement direction. In addition, the nozzle lines a, c, e, and g are formed having the same position in the nozzle arrangement direction and the nozzle lines b, d, f, and h are formed having the same position in the nozzle arrangement direction.

Moreover, for example, the nozzle lines a and b of the recording head 4*a* discharge black droplets, the nozzle line c discharges yellow droplets, and the nozzle line d discharges magenta droplets. In addition, the nozzle lines e and f of the recording head 4*b* discharge cyan droplets, the nozzle line g discharges magenta droplets, and the nozzle line h discharges yellow droplets.

That is, the image forming apparatus has at least two nozzle lines that discharge droplets having at least different colors.

As the liquid discharging head constituting the recording head 4, for example, it is possible to use a piezoelectric actuator such as a piezoelectric element and a thermal actuator that utilizes the phase change caused by film boiling of liquid by using an electric heat conversion element such as a heat element.

The image forming apparatus has a transfer belt 12 serving as a conveying device to transfer a sheet 10 at the position facing the recording head 4 by electrostatically adsorbing the sheet 10 to convey the sheet 10. The transfer belt 12 takes an endless form, stretched between a transfer roller 13 and a tension roller 14.

The transfer belt 12 moves around in the sub-scanning direction by the transfer roller 13 rotationally driven by a sub-scanning motor 16 via a timing belt 17 and a timing pully 18. This transfer belt 12 is charged (charges are imparted) by a charging roller while moving around.

Furthermore, on one side of the main-scanning direction of the carriage 3, a maintaining and restoring mechanism 20 to maintain and restore the recording head 4 is provided laterally to the transfer belt 12. On the other side, a dummy discharging receiver 21 to conduct dummy discharging from the recording head 4 is provided laterally to the transfer belt 12.

The maintaining and restoring mechanism 20 includes a capping member (cap) 27 to cap a nozzle surface (surface on which the nozzle is formed), a wiping member 22 to wipe off the nozzle surface, and the dummy discharging receiver to discharge droplets not used to form an image.

In addition, an encoder scale 23 forming a particular pattern is tensioned between both side plates along the main-scanning direction of the carriage 3, and the carriage 3 has an encoder sensor 24 including a transmissive type photosensor that reads the pattern of the encoder scale 23. These encoder scale 23 and encoder sensor 24 constitute a linear encoder (main scanning encoder) to detect the moving of the carriage 3.

In addition, a code wheel 25 is provided to the shaft of the transfer roller 13, and an encoder sensor 26 having a transmissive type photosensor to detect a pattern formed on the code wheel 25 is provided. These code wheel 25 and encoder sensor 26 constitute a rotary encoder (sub-scanning encoder) to detect the moving amount and the moving position of the transfer belt 12.

In the image forming apparatus having such a configuration, the sheet 10 is fed onto and adsorbed by the charged transfer belt 12 and transferred along the sub-scanning direction by the rotation moving of the transfer 12.

By driving the inkjet head 4 in response to the image signal while moving the carriage 3 in the main-scanning direction, ink droplets are discharged onto the sheet 10 not in motion to record an image in an amount of one line. After the sheet 10 is transferred in a predetermined amount, the recording is conducted for the next line.

On receiving a signal indicating that the recording has completed or the rear end of the sheet 10 has reached the image recording area, the recording operation stops and the sheet 10 is ejected to a paper ejection tray.

Figure 3:
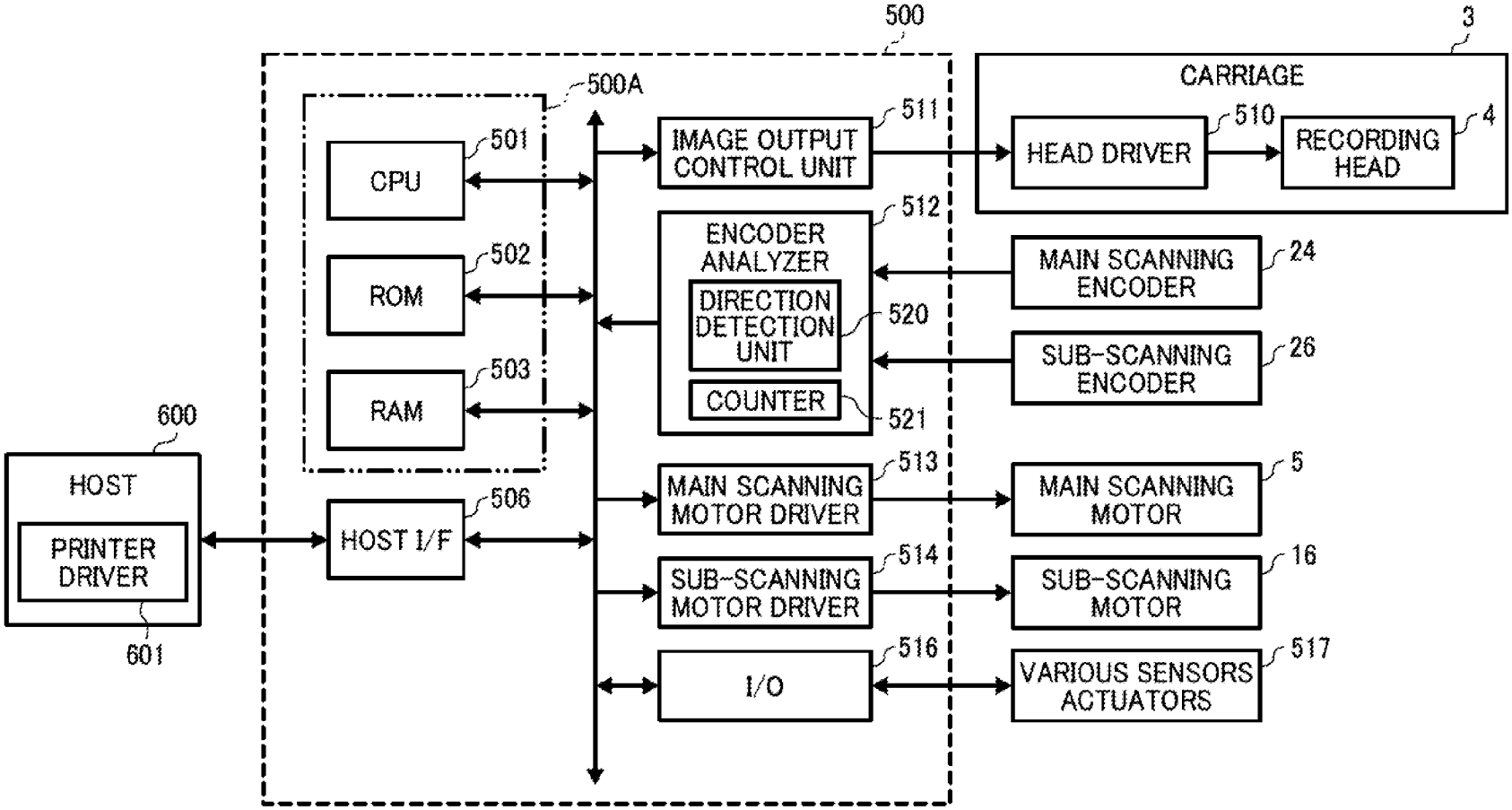
FIG. 3 is a block diagram illustrating a control unit of the image forming apparatus.

Next, the control unit of this image forming apparatus is described with reference to FIG. 3. FIG. 3 is a block diagram illustrating the control unit.

The control unit 500 has a main control unit 500A including a CPU 501 doubling as the control device relating to the present disclosure that controls the entire apparatus, a ROM 502 that stores programs executed by the CPU 501 and other fixed data, and a RAM 503 that temporarily stores image data, etc.

In addition, the control unit 500 has a host I/F 506 that conducts data transfer with a printer driver 601 of an information processing device 600 (host) such as a home computer (PC), an image output control unit 511 that drive-controls the recording head 4, and an encoder analyzer 512. The encoder analyzer 512 inputs and analyzes detection signals from the main scanning encoder sensor 24 and the sub-scanning encoder sensor 26.

In addition, the control unit 500 includes a main scanning motor driver 513 to drive the main scanning motor 5, a sub-scanning motor driver 514 to drive the sub-scanning motor 16, and an I/O 516 with various sensors and actuators 517.

The image output control unit 511 includes a data creating device to create print data, a drive waveform generating device to generate a drive waveform to drive-control the recording head 4, and a data transfer device to transfer head control signal to select a drive signal from the drive waveform and the print data. The image output control unit 511 outputs the drive waveform, the head control signal, and the print data to a head driver 510 serving as a head drive circuit to drive the record head 4 mounted onto the carriage 3 and discharges droplets through the nozzles of the recording head 4 in response to the print data.

Moreover, the encoder analyzer 512 includes a direction detection unit 520 to detect the moving direction from the detection signal and a counter unit 521 to detect the moving amount.

The control unit 500 controls the moving of the carriage 3 by driving and controlling the main scanning motor 5 via the main scanning motor driver 513 based on the analysis result from the encoder analyzer 512. In addition, the control unit 500 controls sending of the sheet 10 by driving and controlling the sub-scanning motor 16 via the sub-scanning motor driver 514.

Figure 4:
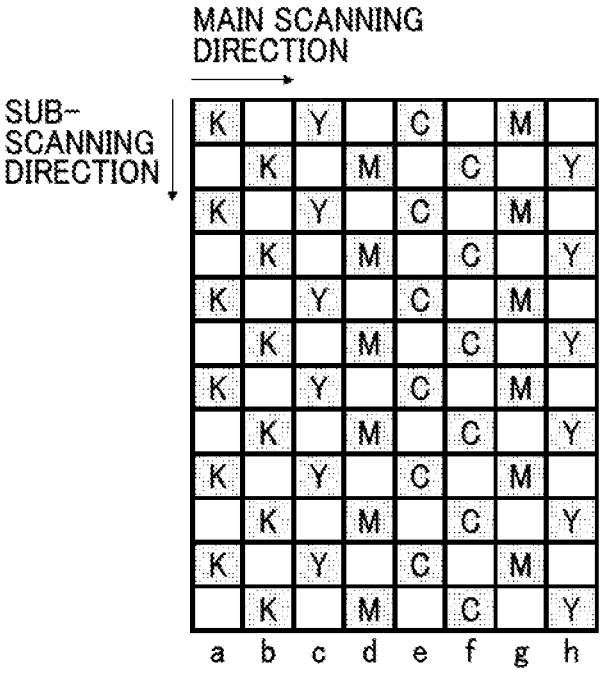
FIG. 4 is a diagram for use in a description of a first embodiment of the present disclosure.

Next, the first embodiment of the present disclosure will be described with reference to FIG. 4. FIG. 4 is a diagram for use in a description of the second embodiment of the present disclosure.

The recording head 4 serving as the image forming unit has eight nozzle lines a to h and each combination of the nozzle lines a and b, c and d, e and f, and g and h is shifted in a zigzag manner in the nozzle arrangement direction (sub-scanning direction).

In this embodiment, each of the nozzle lines a to h has nozzles spaced a distance corresponding to 300 dpi apart (i.e.,), so that the nozzle resolution of a single color is 600 dpi when using the two nozzle lines for the color. Hereinafter, the resolution when droplets are discharged from the adjacent nozzles (i.e., distance between nozzles) for a single color is defined as the nozzle resolution N. More specifically, the distance (pitch or interval) between dots a single color can form for a single scanning along the head longitudinal direction is defined as the nozzle resolution N.

Moreover, the color is assigned in such a manner that, for example, the nozzle lines a and b discharge black (K) droplets, the nozzle line c discharges yellow (Y) droplets, the nozzle line d discharges magenta (M) droplets, the nozzle lines e and f discharge cyan (C) droplets, the nozzle line g discharges magenta (M) droplets, and the nozzle line h discharges yellow (Y) droplets.

Hereinafter, black, yellow, magenta, and cyan are respectively represented by K, Y, M, and C.

Like the color arrangement of this embodiment, if K (black) is arranged on the exterior side in the main-scanning direction, K and CMY (color) are replaced separately with ease. Furthermore, this arrangement is excellent in comparison with the symmetry color arrangement in terms of maintenance and accuracy of landing of black droplets.

The mechanism of how the dual directional color difference occurs when this recording head is used is described next with reference to FIGS. 5A, 5B, 5C, and 5D. FIGS. 5A to 5D are diagrams illustrating a reciprocating behavior and the landing sequence of droplets at each nozzle position for use in a description of the mechanism.

In this embodiment, as illustrated in FIG. 5A, the direction in which droplets land in the sequence from the nozzle line a to the nozzle line h is defined as the outward and as illustrated in FIG. 5C, the direction in which droplets land in the sequence from the nozzle line h to the nozzle line a is defined as the return.

Images are also formed with the nozzle resolution N (600 dpi) in the nozzle arrangement direction (sub-scanning direction).

The landing sequence of droplets at each nozzle position in the sub-scanning direction in the outward printing is, as illustrated in FIG. 5B, KYCM in the dot lines using the nozzle lines a, c, e, and g and KMCY in the dot lines using the nozzle lines b, d, f, and h.

The landing sequence of droplets at each nozzle position in the sub-scanning direction in the outward printing is, as illustrated in FIG. 5D, MCYK in the dot lines using the nozzle lines a, c, e, and g and YCMK in the dot lines using the nozzle lines b, d, f, and h.

Therefore, with regard to the color formed by using the three colors of CMY, the landing sequence of color droplets can be made the same both in the outward and the return by printing in the nozzle arrangement direction with one nozzle shifted.

However, with regard to the colors including K and at least one of CMY, the color landing sequence changes in the outward printing and return printing, thereby causing dual directional color difference to occur.

Next, the color difference handling print control in the embodiment is described with reference to FIG. 6. FIG. 6 is a diagram illustrating a reciprocating behavior and the landing sequence of droplets at each nozzle position for use in a description of the color difference handling print control.

To cause no dual directional color difference to occur, by selectively using nozzles arranged in different positions in the nozzle arrangement direction, no color overlapping is prevented in the same dot.

Figure 6A:
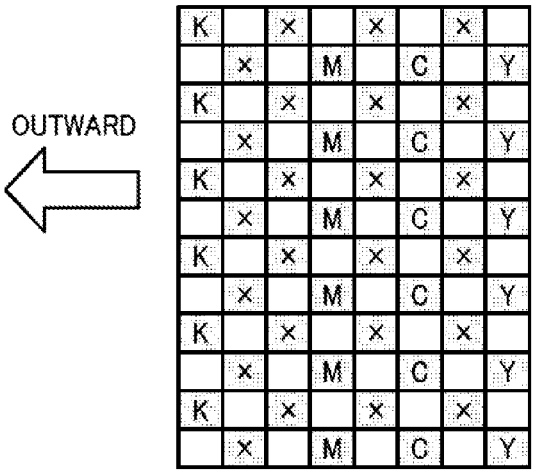
FIGS. 6A, 6B, 6C, and 6D are diagrams illustrating a reciprocating behavior and the landing sequence of droplets at each nozzle position for use in a description of the color difference handling print control in the first embodiment.
Figure 6B:
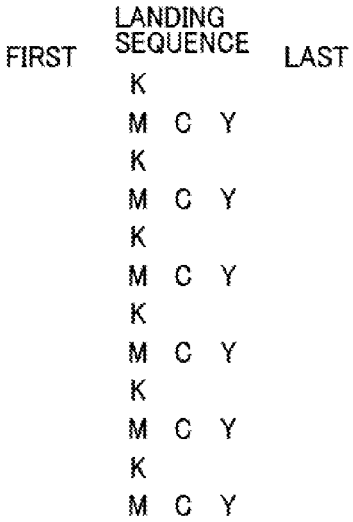
Figure 6C:
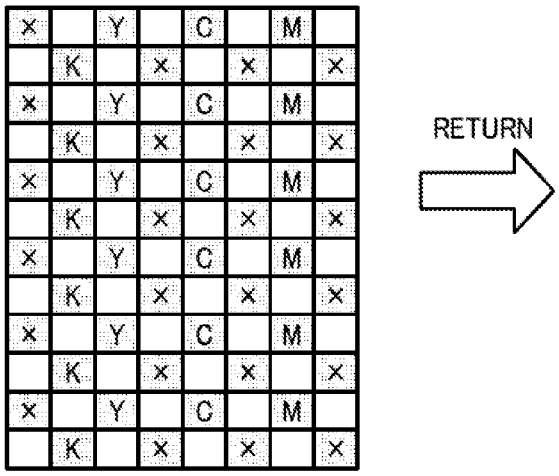

That is, as illustrated in FIGS. 6A, 6B, and 6C, the nozzles marked with x are not used to change the nozzles in the outward and the return.

To be specific, in the outward printing, as illustrated in FIG. 6A, the nozzle line a for K, the nozzle line d for M, the nozzle line f for C, and the nozzle line h for Y are used, but the nozzle line b for K, the nozzle line c for Y, the nozzle line e for C, and the nozzle line g for M are not used.

For this reason, as illustrated in FIG. 6B, in the outward printing, with regard to the dots using the nozzle line a, only droplets of K are discharged and the dots using the nozzle lines d, f, and h land in this sequence of MCY.

In addition, in the return printing, as illustrated in FIG. 6C, the nozzle line b for K, the nozzle line g for M, the nozzle line e for C, and the nozzle line c for Y are used, but the nozzle line a for K, the nozzle line d for M, the nozzle line f for C, and the nozzle line h for Y are not used.

Figure 6D:
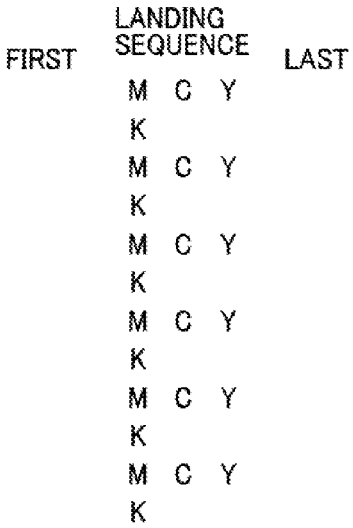

For this reason, as illustrated in FIG. 6D, in the return printing, with regard to the dots using the nozzle line b, only droplets of K are discharged and the dots using the nozzle lines c, e, and g land in this sequence of MCY.

As described above, of the nozzles of the nozzle line discharging K droplets and the nozzles of the nozzle lines discharging MCY droplets, dual directional printing is conducted using only the nozzles having different nozzle positions in the nozzle arrangement direction (sub-scanning direction) and not overlapping in the main-scanning direction.

By having such a configuration, dots lands in the sequence of only K or MCY in the outward and the same is true in the return. That is, the landing sequence of the colors is the same both in the outward and the return.

Therefore, with regard to the color using K and CMY droplets simultaneously, K and CMY droplets land at different dot position in the sub-scanning direction, so that no dual directional color difference occurs.

The nozzle resolution N of a single color formed by two nozzle lines is 600 dpi, but only one of the two nozzle lines is used in the outward and the return, so that the nozzle resolution is 300 dpi, which is less than the nozzle resolution N. Therefore, an obtained image has a lower resolution than when an image formed using all the nozzle lines.

That is, in the dual directional color difference handling printing, by reducing the resolution by using selected nozzles in comparison with the case in which all the nozzles are used, and, with the reduced resolution, the landing positions of the different color droplets are shifted in the nozzle arrangement direction to prevent overlapping in both directions, so that no color difference occurs.

As described above, the configuration of this embodiment includes an image forming unit having at least two nozzle lines each having multiple nozzles to discharge different color droplets and a carriage that carries the image forming unit. The carriage reciprocates in a direction crossing the arrangement direction of the nozzles. When conducting dual-directional printing, of each of the nozzles in the at least two nozzle lines, the nozzles are used which are located at different positions in the arrangement direction of the nozzles and do not overlap in the moving direction of the carriage to discharge droplets of each color.

Therefore, without using liquid discharging heads having a special nozzle line arrangement, dual directional printing can be conducted without causing dual directional color difference.

In the main-scanning direction (carriage moving direction), with regard to the colors having no color symmetry of at least two colors, no dual directional color difference does not occur by avoiding landing of droplets at the same position in the sub-scanning direction (nozzle arrangement direction) although the resolution is reduced. Therefore, the present disclosure can be applied regardless of resolution, nozzle configuration, color sequence, etc.

Figure 7A:
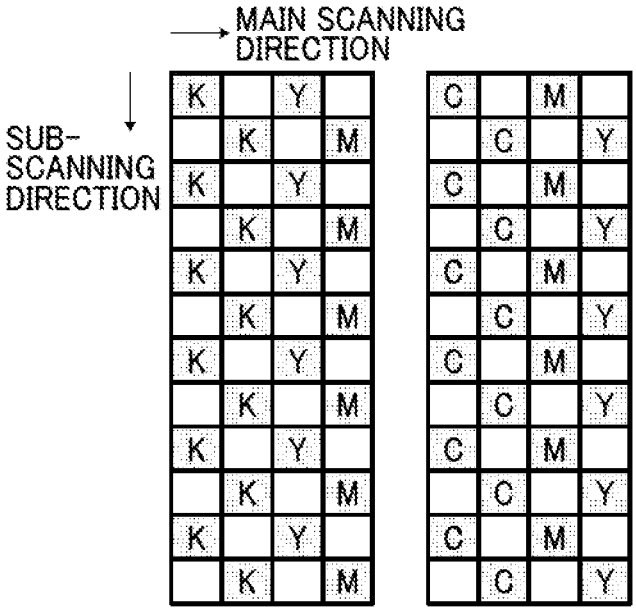
FIGS. 7A, 7B, and 7C are diagrams illustrating the first embodiment having another head configuration.
Figure 7B:
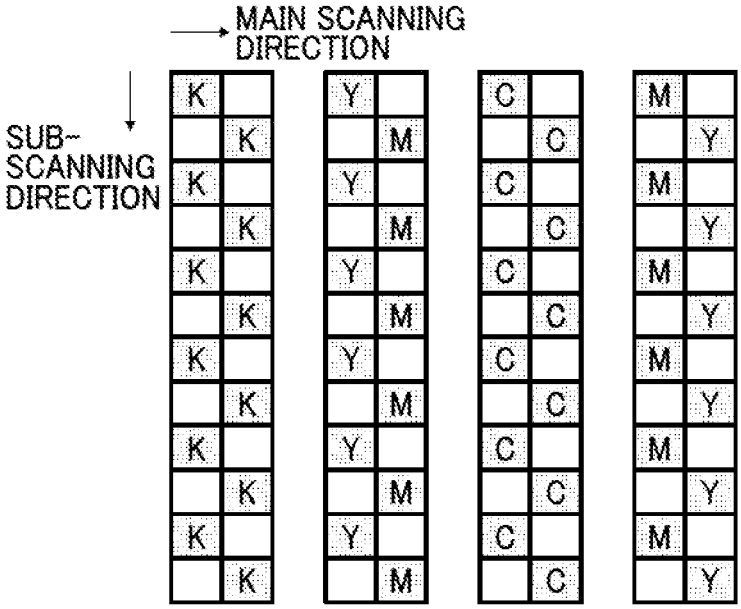
Figure 7C:
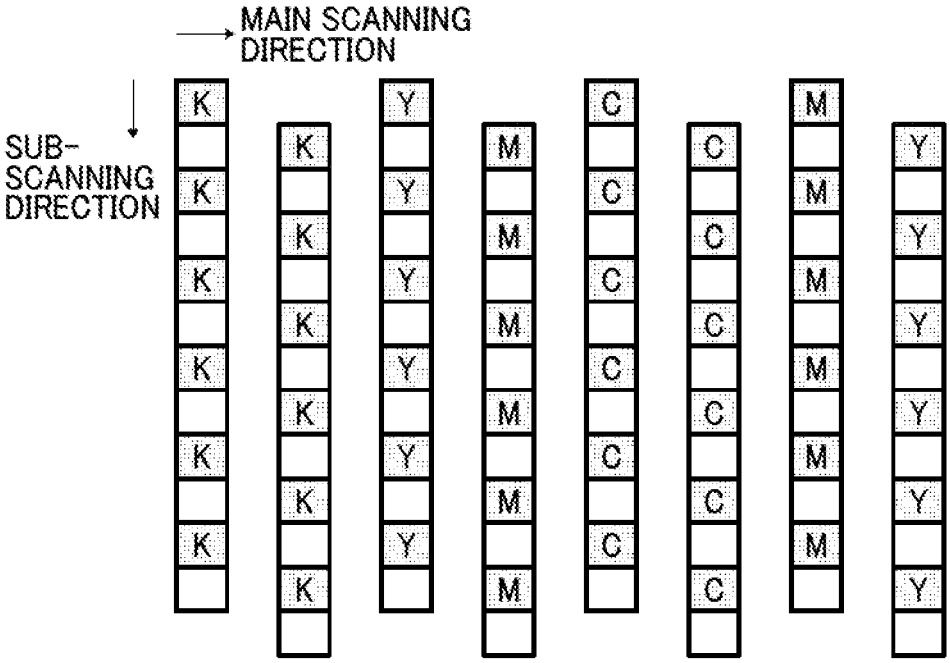
Figure 8A:
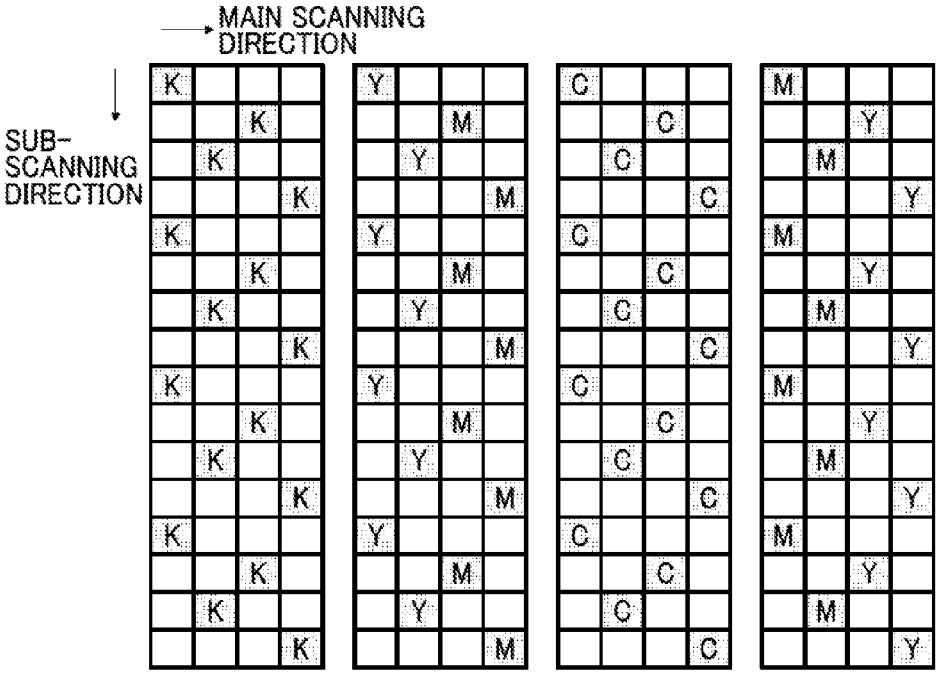
FIGS. 8A and 8B are diagrams for use in a description of the first embodiment having another head configuration and another number of nozzle lines.
Figure 8B:
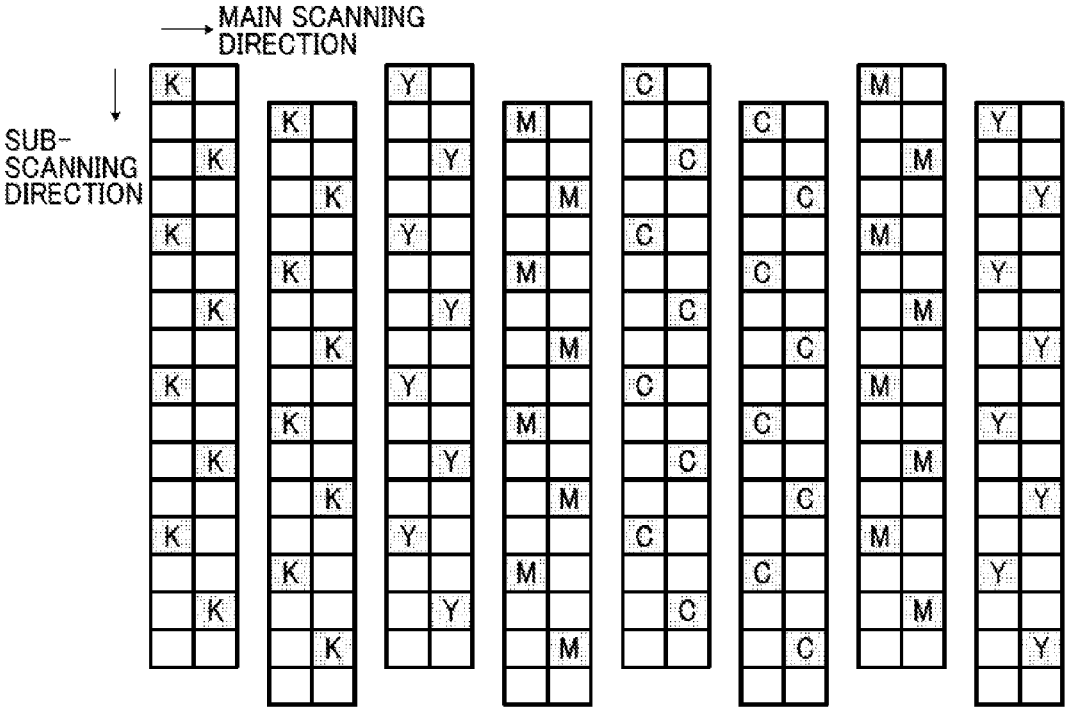

Next, another first embodiment having a different head configuration and a different number of nozzle lines is described with reference to FIGS. 7A, 7B, and 7C and 8A and 8B. FIGS. 7A to 7C are diagrams for use in a description of the first embodiment having another head configuration and FIGS. 8A and 8B are diagrams for use in a description of the first embodiment having another head configuration with a different number of nozzle lines. The symbols "a" to "h" of the nozzle lines are omitted therein.

The first example illustrated in FIG. 7A includes two liquid discharging heads (recording heads) each having four nozzle lines.

The second example illustrated in FIG. 7B includes four liquid discharging heads (recording heads) each having two nozzle lines.

The third example illustrated in FIG. 7C includes eight liquid discharging heads (recording heads) each having one nozzle line.

In these examples, the sequence of the color assignment for each nozzle line and the nozzles for use in color difference handling printing are the same as those described for the first embodiment.

The fourth example illustrated in FIG. 8A includes four liquid discharging heads (recording heads) each having four nozzle lines. In this example, four nozzle lines are assigned per color. In this case, as in the case of the first embodiment, the assignment sequence of color is set for each nozzle line for two nozzle lines.

The fifth example illustrated in FIG. 8B includes eight liquid discharging heads (recording heads) each having two nozzle lines. In this example, four nozzle lines are assigned per color.

In these fourth and fifth example, of each nozzle in the at least two nozzle lines, the nozzles are used which are arranged at different positions in the nozzle arrangement direction and do not overlap in the carriage moving direction. For this reason, dual directional color difference can be avoided by the color difference handling printing control in which each nozzle line discharges its corresponding color droplet.

Figure 9:
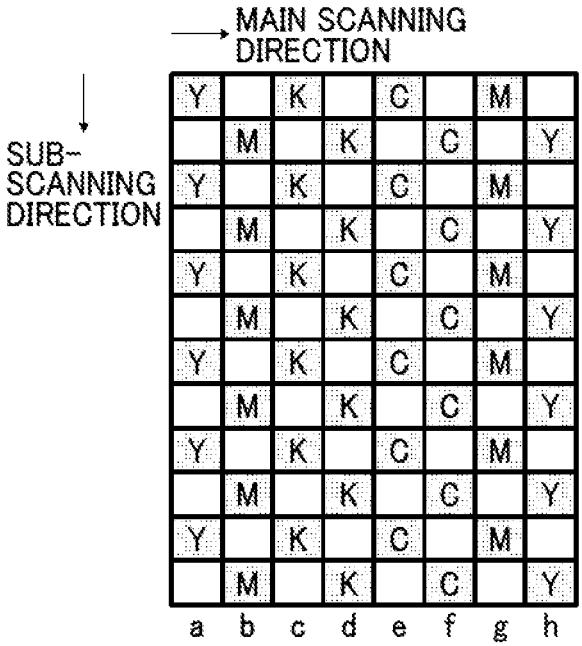
FIG. 9 is a diagram for use in a description of a second embodiment of the present disclosure.

Next, the second embodiment of the present disclosure is described with reference to FIG. 9. FIG. 9 is a diagram for use in a description of the second embodiment of the present disclosure.

The recording head 4 serving as the image forming unit has eight nozzle lines a to h and each combination of the nozzle lines a and b, c and d, e and f, and g and h is shifted in a zigzag manner in the nozzle arrangement direction (sub-scanning direction).

Moreover, the color is assigned in such a manner that, for example, the nozzle line a discharges Y droplets, the nozzle line b discharges M droplets, the nozzle lines c and d discharge K droplets, the nozzle lines e and f discharge C droplets, the nozzle line g discharges M droplets, and the nozzle line h discharges Y droplets.

Next, the color difference handling print control in the embodiment is described with reference to FIGS. 10A, 10B, 10C, and 10D. FIGS. 10A to 10D are diagrams illustrating a reciprocating behavior and the landing sequence of droplets at each nozzle position for use in a description of the print control.

In this embodiment, the nozzles are selectively used in outward and return to prevent dual directional color difference.

Figure 10A:
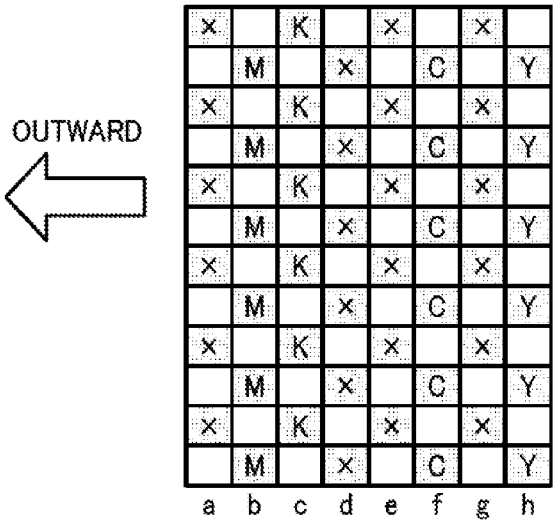
FIGS. 10A, 10B, 10C, and 10D are diagrams illustrating a reciprocating behavior and the landing sequence of droplets at each nozzle position for use in a description of color difference handling print control in a description in the second embodiment.
Figure 10B:
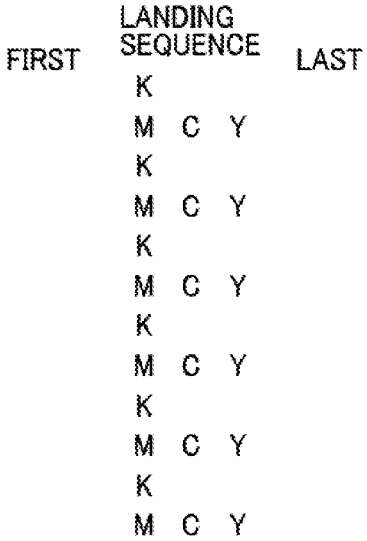
Figure 10C:
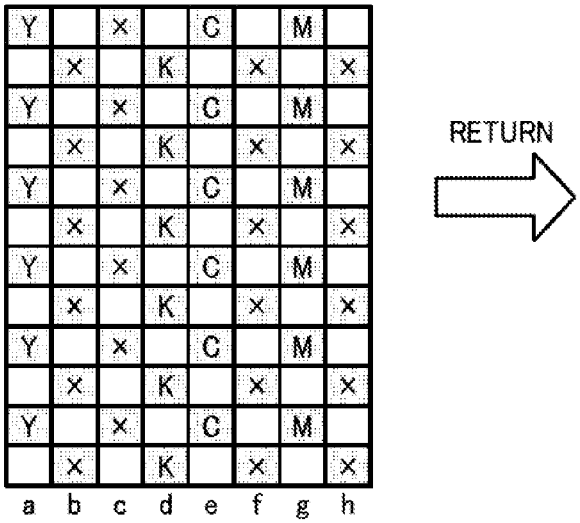

That is, as illustrated in FIGS. 10A and 10C, the nozzles marked with x are not used to change the nozzles in the outward and the return.

To be specific, in the outward printing, as illustrated in FIG. 10A, the nozzle line b for M, the nozzle line c for K, the nozzle line f for C, and the nozzle line h for Y are used, but the nozzle line a for Y, the nozzle line d for K, the nozzle line e for C, and the nozzle line g for M are not used.

For this reason, as illustrated in FIG. 10B, in the outward printing, with regard to the dots using the nozzle line c, only droplets of K are discharged and the dots using the nozzle lines b, f, and h land in this sequence of MCY.

In addition, in the return printing, as illustrated in FIG. 10C, the nozzle line a for Y, the nozzle line d for K, the nozzle line e for C, and the nozzle line g for M are used, but the nozzle line b for M, the nozzle line c for K, the nozzle line f for C, and the nozzle line h for Y are not used.

Figure 10D:
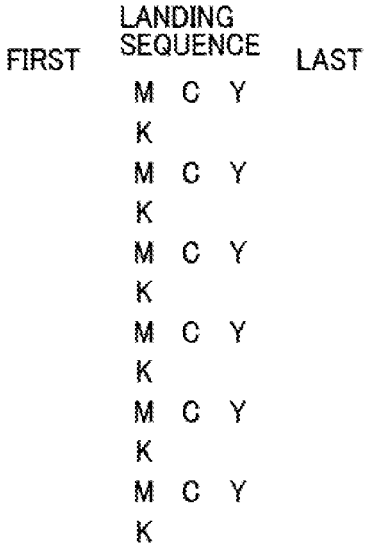

For this reason, as illustrated in FIG. 10D, in the return printing, with regard to the dots using the nozzle line d, only droplets of K are discharged and the dots using the nozzle lines a, e, and g land in this sequence of MCY.

As described above, of the nozzles of the nozzle line discharging K droplets and the nozzles of the nozzle lines discharging MCY droplets, dual directional printing is conducted using only the nozzles having different nozzle positions in the nozzle arrangement direction (sub-scanning direction) and not overlapping in the main-scanning direction.

By having such a configuration, like the first embodiment, the landing sequence in the outward is only K and MCY and the same is true in the return. That is, the landing sequence of the colors is the same both in the outward and the return.

Therefore, with regard to the color using K and CMY droplets simultaneously, K and CMY droplets land at different dot position in the sub-scanning direction, so that no dual directional color difference occurs.

The nozzle resolution N of a single color formed by two nozzle lines is 600 dpi, but only one of the two nozzle lines is used in each of the outward and return, so that the nozzle resolution is 300 dpi, which is less than the nozzle resolution N. Therefore, an obtained image has a lower resolution than when an image formed using all the nozzle lines.

Figure 11:
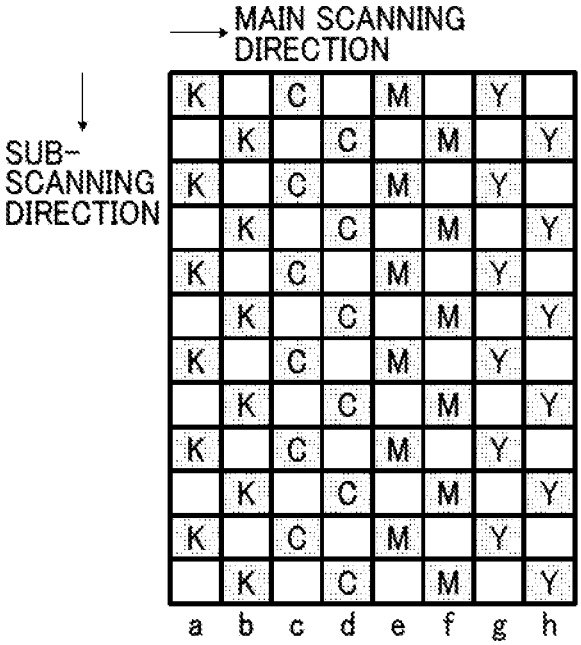
FIG. 11 is a diagram illustrating a third embodiment of the present disclosure.

Next, the third embodiment of the present disclosure is described with reference to FIG. 11. FIG. 11 is a diagram for use in a description of the third embodiment of the present disclosure.

The recording head 4 serving as the image forming unit has eight nozzle lines a to h and each combination of the nozzle lines a and b, c and d, e and f, and g and h is shifted in a zigzag manner in the nozzle arrangement direction (sub-scanning direction). In this embodiment, each of the nozzle lines a to h has nozzles arranged spaced 300 dpi apart (distance between nozzles), so that the nozzle resolution per color is 600 dpi.

Moreover, for example, the nozzle lines a and b discharge black (K) droplets, the nozzle lines c and d discharge cyan (C) droplets, the nozzle lines e and f discharge magenta (M) droplets, and the nozzle lines g and h discharge yellow (Y) droplets.

The mechanism of how the dual directional color difference occurs when this recording head is used is described next with reference to FIGS. 12A, 12B, 12C, and 12D. FIGS. 12A to 12D are diagrams illustrating a reciprocating behavior and the landing sequence of droplets at each nozzle position for use in a description of the mechanism.

In this embodiment, as illustrated in FIG. 12A, the direction in which droplets land in the sequence from the nozzle line a to the nozzle line h is defined as the outward and as illustrated in FIG. 12B, the direction in which droplets land in the sequence from the nozzle line h to the nozzle line a is defined as the return.

Images are also formed with the nozzle resolution N (600 dpi) in the nozzle arrangement direction (sub-scanning direction).

The landing sequence of droplets at each nozzle position in the outward printing is, as illustrated in FIG. 12B, KCMY in the dot lines using the nozzle lines a, c, e, and g and also KCMY in the dot lines using the nozzle lines b, d, f, and h.

The landing sequence of droplets at each nozzle position in the outward printing is, as illustrated in FIG. 12D, YMCK in the dot lines using the nozzle lines a, c, e, and g and also YMCK in the dot lines using the nozzle lines b, d, f, and h.

Therefore, dual directional color difference occurs to all the colors except for a single color of KCMY.

Next, the color difference handling print control in the embodiment is described with reference to FIGS. 13A, 13B, 13C, and 13D. FIGS. 13A to 13D are diagrams illustrating a reciprocating behavior and the landing sequence of droplets at each nozzle position for use in a description of the mechanism.

Figure 13A:
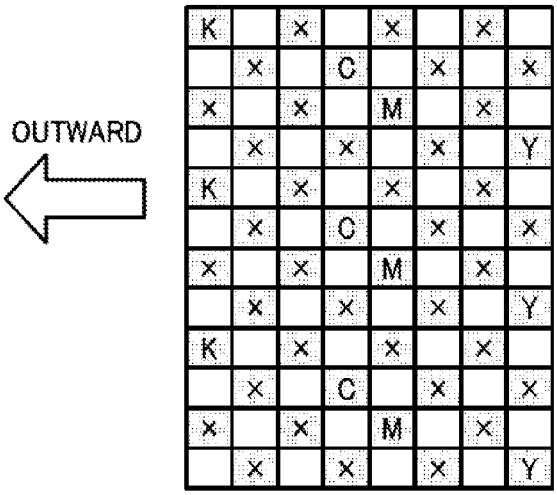
FIGS. 13A, 13B, 13C, and 13D are diagrams illustrating a reciprocating behavior and the landing sequence of droplets at each nozzle position for use in a description of the color difference handling print control in the third embodiment.

To prevent occurrence of dual directional color difference, in the outward printing, as illustrated in FIG. 13A, the nozzle lines a, d, e, and h are shifted an amount corresponding to one nozzle in the nozzle arrangement direction for each color and the nozzle every four nozzles are used in one nozzle line.

Figure 13B:
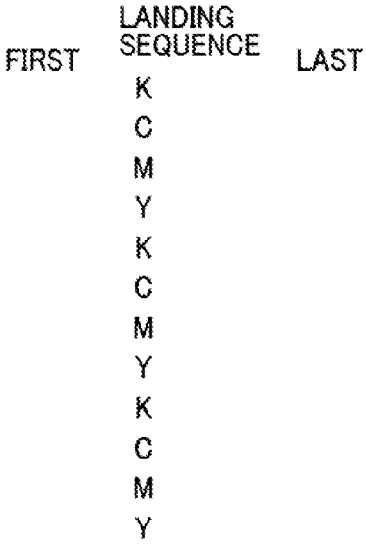

As a result, in the outward printing, as illustrated in FIG. 13B, dots of a single color of K, C, M, and Y are formed in the main-scanning direction and K, C, M, and Y dots are repeated at each nozzle position in the sub-scanning direction.

Figure 13C:
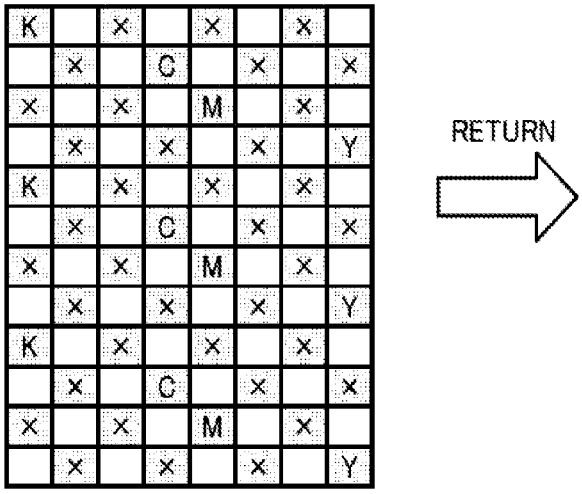

In addition, in the return printing, as illustrated in FIG. 13C, the nozzle lines a, d, e, and h are shifted an amount corresponding to one nozzle in the nozzle arrangement direction for each color and the nozzle every four nozzles are used in one nozzle line.

Figure 13D:
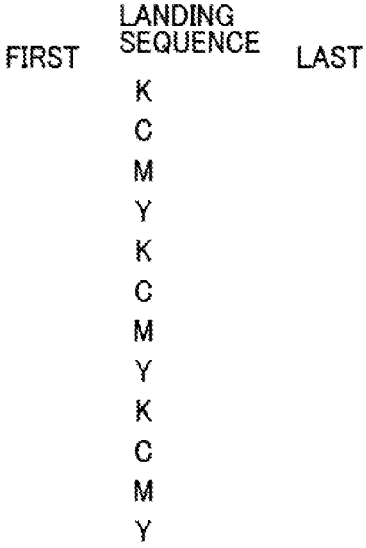
Figure 14A:
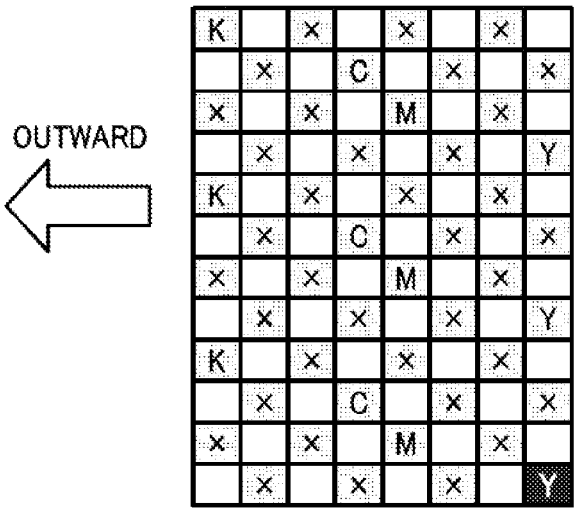
FIGS. 14A, 14B, 14C, 14D, 14E, 14F, 14G, and 14H are diagrams illustrating a reciprocating behavior and the landing sequence of droplets at each nozzle position for use in a description of a fourth embodiment of the present disclosure.
Figure 14B:
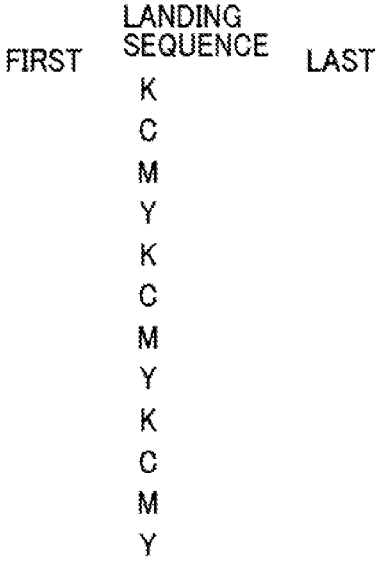
Figure 14C:
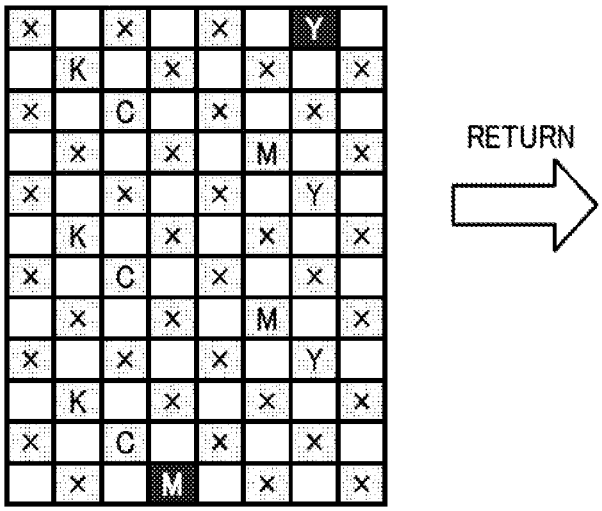
Figure 14D:
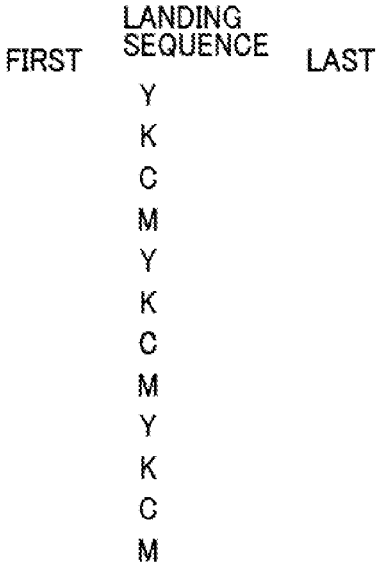
Figure 14E:
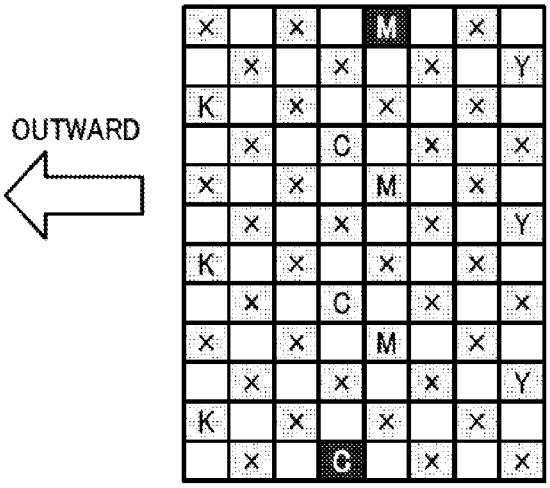
Figure 14F:
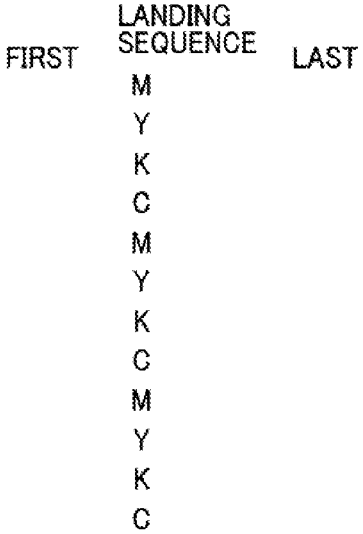
Figure 14G:
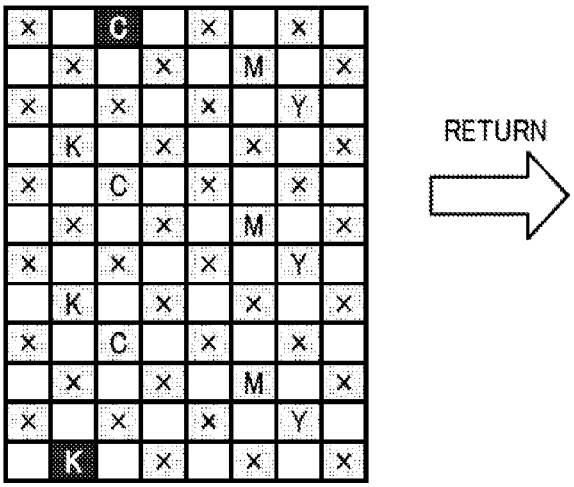
Figure 14H:
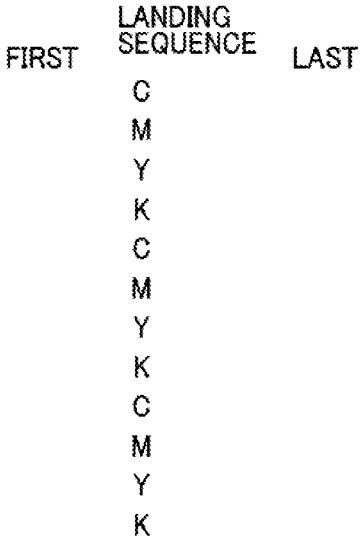

As a result, in the return printing, as illustrated in FIG. 13D, dots of a single color of K, C, M, and Y are formed in the main-scanning direction and K, C, M, and Y dots are repeated at each nozzle position in the sub-scanning direction.

That is, since the landing positions for all of the four colors of KCMY are shifted in the sub-scanning direction, the used nozzles of the nozzle lines of each color is thin out to one fourth. In addition, to align the landing sequence of color in the sub-scanning direction, it is suitable to limit the used nozzle per scanning to the positions of multiples of four (in the example illustrated in FIG. 13, up to the 12th nozzle is used).

The nozzle resolution N of a single color formed by two nozzle lines is 600 dpi, but the nozzles of one of the two nozzle lines are used every other nozzle in the outward and the return, so that the nozzle resolution is 75 dpi, which is less than the nozzle resolution N. Therefore, an obtained image has a lower resolution than when an image formed using all the nozzle lines.

Next, the fourth embodiment of the present disclosure is described with reference to FIGS. 14A, 14B, 14C, 14D, 14E, 14F, 14G, and 14H. FIGS. 14A to 14H are diagrams illustrating a reciprocating behavior and the landing sequence of droplets at each nozzle position for use in a description of the fourth embodiment.

In the third embodiment, no dual directional color difference does not occur irrespective of switching the nozzles in the outward and the return. However, since the used nozzles per color is thinned out to one fourth, the non-used nozzles are dried quickly, thereby easily degrading discharging reliability.

Therefore, in the fourth embodiment, the nozzles for use in each color are shifted. That is, the nozzles used are shifted an amount corresponding to one nozzle in the sub-scanning direction for each scan.

In this case, the number of nozzles used and the amount of line feeding of the sheet have to be changed in response to this nozzle shift in the sub-scanning direction for each scanning.

First, with regard to the amount of the line feeding, the line is fed in an amount corresponding to the head length minus the distance between nozzles. Otherwise, the color sequence changes in the sub-scanning direction. To be specific, for the first scan, the colors are arranged in the sequence of KCMY from the top toward the bottom of the sheet, but this sequence is broken at the seam between the first scan and the second scan. This applies to the following seam and thereafter.

In addition, if the line feed amount is corrected, when the nozzles are used from the top to the bottom of the head, the dots formed by the ink discharged from the bottom nozzle in the scanning overlap with the dots formed by the ink discharged from the top nozzle of the next scanning. For example, the dots of the outlined texts on the black background overlap in FIGS. 14A to 14H.

For this reason, it is preferable that one of the bottom nozzle in the scanning and the top nozzle in the next scanning is not used, or discharging is shared between the two nozzles (for example, alternately discharged in the main-scanning direction).

In this case, the sub-scanning resolution of each color is decreased to one fourth of the nozzle resolution, but the dual directional color difference does not occur in spite that the nozzle lines have no color symmetry arrangement at all.

When the nozzle resolution is 1,200 dpi, the resolution per color is 300 dpi. When the nozzle resolution is 600 dpi, the resolution per color is 150 dpi. Therefore, although the resolution lowers, no image trouble such as dual directional color difference occurs for all over the entire of a sheet, which is up to a practical level considering the mode with an emphasis on speed.

Next, the fifth embodiment of the present disclosure is described.

Data to each nozzle described in the embodiment described above are converted into a suitable resolution by the application on the host 600, the printer driver 601, or the control unit 500 of the image forming apparatus.

For example, the first embodiment is described under the condition that the nozzle resolution N is 600 dpi. In this case, since the sub-scanning resolution of each color is 300 dpi, images having a sub-scanning resolution of 300 dpi is formed and the corresponding nozzle lines are assigned.

It is also possible to make a control such that data are input at 600 dpi and the nozzles are not used. However, since information is deficient in this case, it is preferable to create data of 300 dpi on data in advance.

In addition, for example, when creating data of 600 dpi×300 dpi, if data of 600 dpi×600 dpi are simply thinned out, data deficiency occurs. Therefore, data of 300 dpi×300 dpi are horizontally enlarged to create data of 600 dpi×300 dpi. Alternatively, when thinning out data of 600 dpi×600 dpi, it is preferable to distribute the information of the thinned-out pixel to pixels there around instead of complete deficiency of the information by various interpolation methods such as a high cubic method.

These data are created by the application on applications on the host 600, programs on the printer driver 601, or programs on the control unit 500 of the image forming apparatus.

As described above, of print data created for an image forming apparatus including an image forming unit that has at least two nozzle lines each having multiple nozzles to discharge different color droplets and is carried by a carriage that reciprocates in a direction crossing an arrangement direction of the nozzles, when the print data for dual-directional printing in which an image is formed in the outward and the return of the carriage, print data are created to discharge droplets of each color by using, of each of the nozzles in the at least two nozzle lines, the nozzles located at different positions in the arrangement direction of the nozzles while not overlapping in the moving direction of the carriage.

The program to execute dual directional printing images by a computer in the outward and the return of the carriage that carries an image forming unit having at least two nozzle lines each having multiple nozzles to discharge different color droplets and reciprocates in a direction crossing the arrangement direction of the nozzles has a configuration to execute the processing of discharging color droplets by the computer by using the nozzles that are located at different positions in the arrangement direction of the nozzles and do not overlap in the moving direction of the carriage of each of the nozzles in the at least two nozzle lines during dual directional printing.

Next, the sixth embodiment of the present disclosure is described.

The dual directional color difference is basically perceived in an area having a size to some extent since the color is different in the outward and the return.

In this embodiment, whether color difference handling printing is executed is determined depending on the kind of printed images (kind of object).

Some known applications distinguish objects constituting image data such as texts, lines, images, and fills (figures or graphic). In addition, a technology referred to as image area separation distinguishes characteristic image areas from texts and lines in an image.

Whether color difference handling printing is conducted is determined for each distinguished object to convert resolution.

To be specific, color difference handling printing is not applied to objects such as texts and lines whose quality is dependent on print resolution since color difference is not conspicuous but forms are important, but high resolution input data are created for printing. In this case, portions where colors not in color symmetry arrangement (two nozzle lines discharging the same color arranged in line symmetry) are used incur dual directional color difference.

To the contrary, since image and fill images have large areas in most cases so that the color difference thereof is easily perceived, occurrence of dual directional color difference is avoided by selectively using nozzles in the outward and the return during color difference handling printing in which sub-scanning resolution is lowered.

In this case, since the resolutions are different for texts, lines, and others, it is preferable to use drive waveform for use in printing suitable for each. For example, since the resolutions for texts and lines are high, waveforms for small droplets are used, and since the resolutions for the other objects are low, waveforms for large droplets are used. Different waveforms or the same waveform having multiple values can be used to control droplets. For example, in the case of four values: large, middle, small, and none. Small or middle-sized droplets are used for texts and lines having high resolutions and large, middle, or small-sized droplets are used for the other object of a low resolution than the texts and lines.

Next, the seventh embodiment of the present disclosure is described.

In this embodiment, whether the color difference handling printing is conducted depends on whether there is a color causing dual directional color difference in print data.

Dual directional color difference occurs when the landing sequence of the colors is different between the outward and the return. Therefore, whether there is a color causing dual directional color difference in image data is determined, and thereafter whether to conduct the color difference handling printing is decided.

The color causing the dual directional color difference is formed by overlapping droplets discharged from at least two color nozzle lines having no color symmetry relation in the nozzle arrangement direction.

For example, a general application has color information by RGB and converts into a color version data (four version data of KCMY in this embodiment) that an image forming apparatus can handle at a printer (including a printer driver). Like the first embodiment described above, a color having at least one color of K and CMY causes dual directional color difference in the color sequence configuration of KKYMC-CMY.

Therefore, combinations of RGB causing K and CMY at the same time are determined in advance, and whether the combinations are present in input data (input image) is checked. Alternatively, subsequent to the conversion from RGB into KCMY, the image is subject to raster processing. Thereafter, whether there is a pixel having a dot of K and either of CMY at the same place is checked.

As described in each embodiment, if there is a color causing the dual directional color difference in the data, the color difference handling print control that selectively uses nozzles is conducted, and if not, dual directional printing is conducted with normal nozzle resolution since no dual directional color difference occurs.

Whether there is a color solely causing the dual directional color difference can be determined by whether a color causing the dual directional color difference is contained. If there is a color causing the dual directional color difference irrespective of the outward or the return, an image is depicted in the outward and the absolute color thereof changes in the return. Therefore, the color difference handling printing is conducted to reduce the occurrence of the dual directional color difference.

Moreover, whether the color difference occurs both in the outward and the return can be determined by whether a color causing the dual directional color difference is contained. That is, if the color causing the dual directional color difference is present at a position only in one of the outward or the return, the dual directional color difference is not perceived as non-uniform in a single image. Since the difference between the outward and the return makes a color difference, absolute color shift is perceived if the color exists only in either of the outward and the return. However, it is not perceived as so-called color unevenness on the band. Therefore, it is possible to conduct the color difference handling printing to reduce the dual directional color difference only when there is a color existing in both of the outward and the return.

Next, the eighth embodiment of the present disclosure is described with reference to FIG. 15 and FIG. 16. FIG. 15 and FIG. 16 are different examples of tables to describe this embodiment.

In this embodiment, the conditions in which the color difference handling printing is conducted to reduce the dual directional color difference are separated by stages.

That is, with regard to the colors causing color difference, the level of the color difference depends on the number of the colors to be overlapped and attached amount. As the number of colors having color sequences having non-symmetry relation in the main-scanning direction increases, the color difference tends to deteriorate. As the mutual attached amount of colors having color sequences having non-symmetry relation increases, the color difference tends to deteriorate. Due to the phenomenon caused by permeation of droplet landing, the color difference basically deteriorates as the amount of overlapping increases.

When there is a color having a color difference equal to or greater than a value (reference), color difference handling printing is conducted.

For example, as illustrated in FIG. 15, the table has information about KCMY values or RGB values combined with information about whether to conduct color difference handling printing. In this case, whether to conduct color difference handling printing depends on whether one or more pairs of colors having non-symmetry color arrangement is used.

In addition, as illustrated in FIG. 16, the table has information about KCMY values or RGB values combined with information about whether to conduct color difference handling printing. However, whether to conduct color difference handling printing depends on whether dual directional color difference is equal to or greater than a value (reference).

For example, when $\Delta E$, which is frequently used to discuss the color difference, is a value (reference) or above, the dual directional handling printing control is conducted. When less than the reference, the dual directional handling printing control is not conducted. Thereafter, whether $\Delta E$ not less than the reference occurs is checked for each KCMY value or RGB value, and the information is maintained as a table to determine whether to conduct color difference handling.

The reference for ΔE changes depending on how a designer thinks, but the color difference in the areas adjacent to each other is said to become significant when ΔE is 1.5 or greater. Therefore, for example, in the case of the combination of colors having a relation: ΔE is 1.5 or greater, the color difference handling described above can be conducted. However, the reference for ΔE is not limited to this, and the reference can be changed by color.

Next, the ninth embodiment of the present disclosure is described with reference to FIGS. 17A, 17B, 17C, 17D, and 17E. FIGS. 17A to 17E are diagrams for use in a description of the ninth embodiment of the present disclosure.

In this embodiment, unlike the eighth embodiment described above, whether the color difference handling printing is conducted does not depend on whether there is a color causing a color difference in an image but on detection of an area causing a color difference in the image.

That is, when whether a color causing a color difference in an image is contained is checked, the image area is separated into an area A having a color causing a color difference and an area B having a color causing no color difference (or a smaller color difference than the reference value).

Figure 17A:
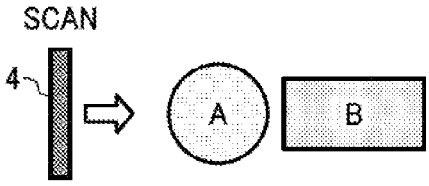
FIGS. 17A, 17B, 17C, 17D, and 17E are diagrams for use in a description of a ninth embodiment of the present disclosure.
Figure 17B:
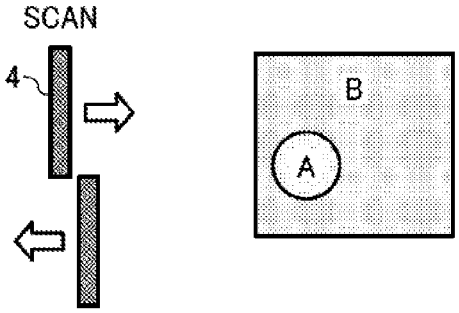

As illustrated in FIG. 17A and FIG. 17B, the color difference handling printing is conducted for the area A and the area B is printed with a normal resolution.

In this case, after the area separation, image processing is conducted by area with the corresponding resolution thereto.

In addition, if it is difficult to receive an image with its corresponding resolution after the area separation in terms of the flow of the processing, it is possible to receive an image with a uniform resolution and internally convert the resolution in the image after the area separation.

For example, an image 600 dpi×300 dpi is received and the resolution of the area A is left as is. The area B is subject to interpolation to increase the resolution to 600 dpi×600 dpi. Alternatively, an image 600 dpi×600 dpi is received and the resolution of the area B is left as is. The area A is subject to interpolation to decrease the resolution to 600 dpi×300 dpi.

Figure 17C:
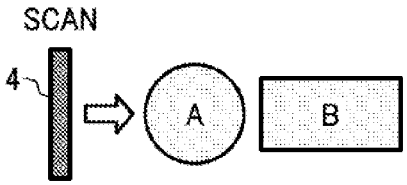

Moreover, when the area A and the area B having different resolutions are present in an image in such a manner that the image is not able to be formed with the two resolutions by scanning once, for example, the color difference handling printing is conducted with priority on the area A as illustrated in FIG. 17C.

Figure 17D:
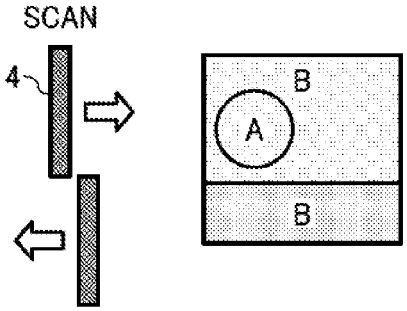

However, if the area A and the area B are present in one scanning as illustrated in FIG. 17D, when the area B is printed by color difference handling and the area B solely extends to the next scanning, the next scanning is free of the color difference. Therefore, printing can be conducted at the normal resolution. However, since the image is sequentially formed in the scannings, the sense of strangeness is possibly provoked if the resolution is changed in the middle of the scannings.

Figure 17E:
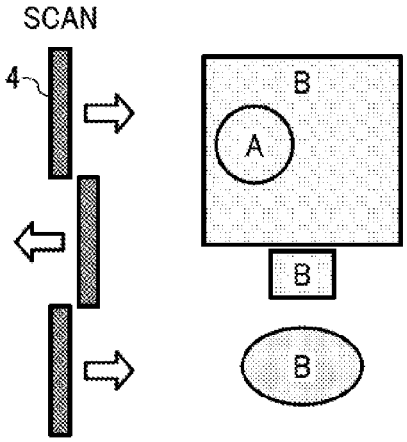
Figure 19A:
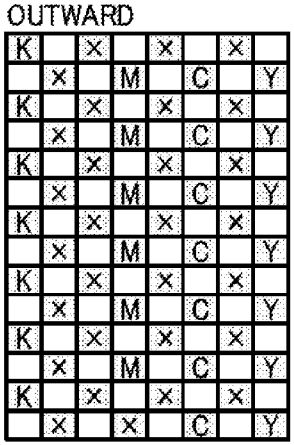
FIGS. 19A, 19B, 19C, 19D, 19E, 19F, 19G, 19H, 19I, and 19J are diagrams for use in a description of an eleventh embodiment of the present disclosure.
Figure 19B:
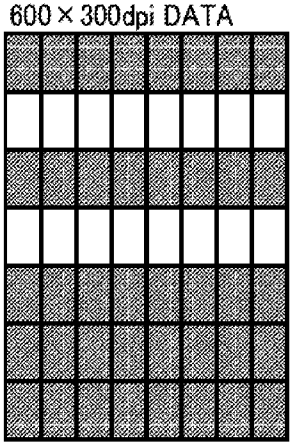
Figure 19C:
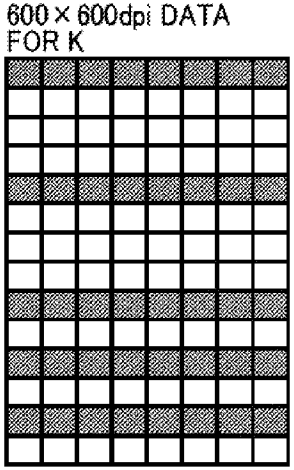
Figure 19D:
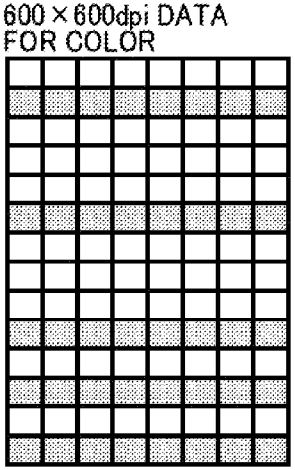
Figure 19E:
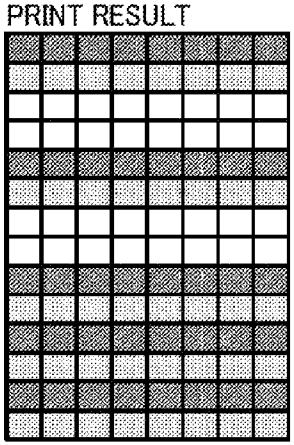
Figure 19F:
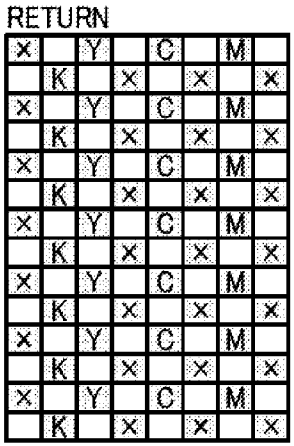
Figure 19G:
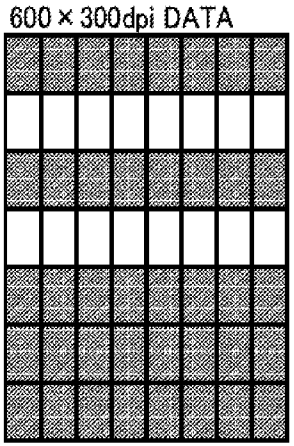
Figure 19H:
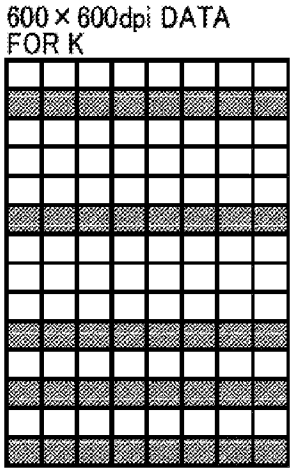
Figure 19I:
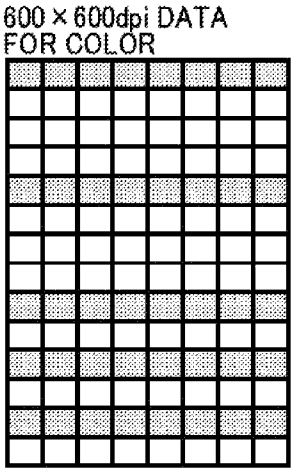
Figure 19J:
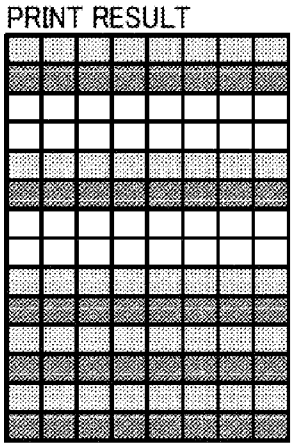

Therefore, as illustrated in FIG. 17E, if an image formed by the previous scanning is sequentially formed by another scanning (not interrupted by space), it is preferable that the image is formed by an image forming method for the area A and thereafter an image forming method reflecting the resolution is applied where the area B is solely present.

That is, connection by area is detected by known image processing referred to as labeling processing followed by the selection of an image forming method.

It is also preferable to change the waveform used or multiple value levels according to the resolution.

Such print data of low resolution to conduct color difference handling printing can be created by host (i.e., information processing device) or an image forming apparatus as described above.

Next, the tenth embodiment of the present disclosure is described. The host (information processing device) converts image data into print data of 600 dpi×600 dpi and blank data are assigned to positions where no droplets are discharged.

As a device to generate print data from image data by assigning blank data to the positions where no droplets are discharged, it is possible to use the print driver 601 illustrated in FIG. 1 or provide a hardware such as an image processing circuit in the host (information processing device) 600.

The host (information processing device) can create such print data to discharge droplets of each color by using the nozzles arranged at different positions along the nozzle arrangement direction and not overlapping in the direction of movement of the carriage, which obviates the need for controlling the use of the nozzles conducted by the image output control unit 511 illustrated in FIG. 1. That is, since print data are created in such a manner that the nozzles only for data to be output for a printer are used, 600 dpi×600 dpi data are printed by the printer (image forming apparatus).

FIGS. 18A, 18B, 18C, 18D, 18E, 18F, 18G, and 18H respectively represent the arrangement of nozzles (a), the data for K (b), the data for color (c), and the print result (d) in the outward operation, and the arrangement of nozzles (e), the data for K (f), the data for color (g), and the print result (h) in the return operation. The image data are converted into print data (data for K (b) and data for color (c) in the outward operation, and data for K (e) and data for color (f)) in which blank data are assigned to the position no image data are to be printed and the data are output to the printer via the host/IF illustrated in FIG. 1.

Next, the eleventh embodiment of the present disclosure is described (refer to FIG. 19). This eleventh embodiment is to solve a case of the tenth embodiment in which color of breadth of lines changes depending on positions since the original data are 600 dpi×600 dpi when there are data having odd numbered horizontal lines of 600 dpi.

FIGS. 19A, 19B, 19C, 19D, 19E, 19F, 19G, 19H, 19I, and 19J respectively represent the arrangement of nozzles (a), the image data of 600×300 dpi (b), the data for K (c), the data for color (d), and the print result (e) in the outward operation, and the arrangement of nozzles (f), the image data of 600×300 dpi (g), the data for K (h), the data for color (i), and the print result (j) in the return operation. The image data (b) and the image data (g) are the same since the image data are the same in the outward and return operations.

First, the data for K and the data for color are created based on 600 dpi×300 dpi. If an application supports 600 dpi×300 dpi, 600 dpi×300 dpi data are created as they are. Alternatively, 300 dpi×300 dpi data are created first followed by multiplication or doubling to 600 dpi×300 dpi.

Thereafter, lines of blank data are inserted into the pixel data of 600 dpi×300 dpi at different positions for K and color to create print data (refer to (c), (d), (h), and (i)), thereby to print 600 dpi×600 dpi data.

Like the tenth embodiment, only the selected nozzles are used at the stage of print data in this embodiment so that the printer can print the data without controlling use of nozzles as if the data were normal 600 dpi×600 dpi. In addition, since the original data are 300 dpi in the sub-scanning direction, K and color are generated in a set so that the color and the breadth of lines do not change depending on positions unlike the tenth embodiment.

That is, according to the present disclosure, an image forming apparatus is provided which is capable of executing dual-directional printing free of dual-directional color difference without using a liquid discharging head having a special nozzle arrangement.

Incidentally, "sheet"is not limited to paper materially, but includes transparent sheets, cloth, glass, substrates, others to which ink droplets and other liquid can be attached, and articles referred to as a recording medium, a recording sheet, recording paper, etc. Moreover, image forming, recording, and printing represent the same meaning.

In addition, the image forming apparatus is to form images by discharging a liquid onto media such as paper, thread, fabric, cloth, leather, metal, plastic, glass, wood, and ceramic. Moreover, the image forming means imparting (simply landing droplets on a medium) not only an image carrying a meaning such as texts or figures but also an image carrying no meaning such as a pattern on a medium.

In addition, the ink is not limited to just an article referred to as ink but means a generic term for liquid capable of forming images, referred to as a recording liquid, fixing processing fluid, liquid, etc. unless otherwise specified.

In addition, the image is not limited to two-dimensional but includes an image imparted to a sterically formed article and an image formed by modeling a three-dimensional object.

In addition, the image forming apparatus includes both a serial type image forming apparatus and a line type image forming apparatus unless otherwise specified.

According to the present invention, an improved image forming apparatus is provided capable of executing dual-directional printing free of dual-directional color difference without using a liquid discharging head having a special nozzle arrangement.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. An image forming apparatus comprising:

an image forming unit comprising plural nozzle lines to discharge different color droplets, each nozzle line having multiple nozzles arranged in a nozzle arrangement direction;

a carriage that carries the image forming unit and is configured to reciprocate in a moving direction crossing the nozzle arrangement direction of the nozzles; and a control device to control dual-directional printing to form an image using the plural nozzle lines in an outward direction and a return direction of the carriage, wherein at least two non-adjacent nozzle lines amongst the plural nozzle lines discharge droplets of same color, wherein the control device executes color difference handling print control to control the image forming unit to discharge the different color droplets by using, amongst all of the nozzles in the plural nozzle lines, plural nozzles located at different positions in the arrangement direction of the nozzles while not overlapping in the moving direction of the carriage, and wherein amongst each pair of adjacent nozzles of respective nozzle lines amongst the plural nozzle lines, one nozzle, amongst the pair of adjacent nozzles and in one nozzle line, is shifted in the nozzle arrangement direction relative to the other nozzle, amongst the pair of adjacent nozzles and in the adjacent nozzle line that is adjacent to the one nozzle line, and the control device selectively controls discharge by the pair of adjacent nozzles of respective nozzle lines such that when the one nozzle is ejecting while the carriage moves in the outward direction, the other nozzle which is adjacent to, and is shifted in the nozzle arrangement direction relative to, the one nozzle is not ejecting, and when the other nozzle is ejecting while the carriage moves in the return direction, the one nozzle which is adjacent to the other nozzle is not ejecting.

2. The image forming apparatus according to claim 1, wherein the control device selectively uses the nozzles each having a nozzle resolution less than a nozzle resolution N in the color difference handling print control, where the nozzle resolution N represents a resolution obtained when the droplets are discharged with a nozzle distance in the arrangement direction of the nozzles.

3. The image forming apparatus according to claim 1, wherein the control device determines whether to execute the color difference handling print control depending on a kind of printed images.

4. The image forming apparatus according to claim 3, wherein the color difference handling print control is executed when the printed images are images or fill image.

5. The image forming apparatus according to claim 1, wherein whether a color causing a color difference is contained in an input image or printed image in the dual-directional printing is determined and the color difference handling print control is executed when the color causing a color difference is contained.

6. The image forming apparatus according to claim 1, wherein the control device determines whether a color causing a color difference equal to or greater than a value is contained in an input image or printed image in the dual-directional printing and the control device executes the color difference handling print control when the color causing a color difference greater than the value is contained.

7. The image forming apparatus according to claim 1, wherein an input image or a print image is separated into an area including a color causing a color difference in the dual-directional printing and an area including no color causing a color difference therein and the control device executes the color difference handling print control in the area including the color causing a color difference.

8. The image forming apparatus according to claim 1, wherein an input image or a print image is separated into an area including a color causing a color difference equal to or greater than a value in the dual-directional printing and an area including no color causing a color difference equal to or greater than the value therein and the control device executes the color difference handling print control in the area including the color causing a color difference equal to or greater than the value.

9. The image forming apparatus according to claim 1, wherein two or more nozzle lines discharge black droplets and other nozzle lines discharge color droplets.

10. An information processing device to create print data for an image forming apparatus including:

a carriage carrying an image forming unit that has plural nozzle lines to discharge different color droplets, each nozzle line having multiple nozzles arranged in a nozzle arrangement direction, wherein at least two non-adjacent nozzle lines amongst the plural nozzle lines discharge droplets of same color, and wherein the carriage reciprocates in a direction crossing the nozzle arrangement direction of the nozzles, and dual directional printing by the image forming unit is controlled based on the print data created by the information processing device in which an image is formed in an outward direction and a return direction of the carriage to discharge droplets of each color by using, amongst all of the nozzles in the plural nozzle lines, plural nozzles located at different positions in the arrangement direction of the nozzles while not overlapping in the direction of movement of the carriage, wherein amongst each pair of adjacent nozzles of respective nozzle lines amongst the plural nozzle lines, one nozzle, amongst the pair of adjacent nozzles and in one nozzle line, is shifted in the nozzle arrangement direction relative to the other nozzle, amongst the pair of adjacent nozzles and in the adjacent nozzle line that is adjacent to the one nozzle line, and discharge by the pair of adjacent nozzles of respective nozzle lines is controlled based on the print data created by the information processing device such that when the one nozzle is ejecting while the carriage moves in the outward direction, the other nozzle which is adjacent to, and is shifted in the nozzle arrangement direction relative to, the one nozzle is not ejecting, and when the other nozzle is ejecting while the carriage moves in the return direction, the one nozzle which is adjacent to the other nozzle is not ejecting.

11. An image forming method comprising:

dual-directionally printing an image in an outward direction and a return direction of a carriage that carries an image forming unit having plural nozzle lines to discharge different color droplets and reciprocates in a moving direction crossing a nozzle arrangement direction of the nozzles, each nozzle line having multiple nozzles in the nozzle arrangement direction, wherein at least two non-adjacent nozzle lines amongst the plural nozzle lines discharge droplets of same color; and performing color difference handling print control in the dual-directional printing to control the image forming unit to discharge the different color droplets by using, amongst all of the nozzles in the plural nozzle lines, plural nozzles located at different positions in the arrangement direction of the nozzles while not overlapping in the moving direction of the carriage, wherein amongst each pair of adjacent nozzles of respective nozzle lines amongst the plural nozzle lines, one nozzle, amongst the pair of adjacent nozzles and in one nozzle line, is shifted in the nozzle arrangement direction relative to the other nozzle, amongst the pair of adjacent nozzles and in the adjacent nozzle line that is adjacent to the one nozzle line, and the color difference handling print control controls discharge by the pair of adjacent nozzles of respective nozzle lines such that when the one nozzle is ejecting while the carriage moves in the outward direction, the other nozzle which is adjacent to, and is shifted in the nozzle arrangement direction relative to, the one nozzle is not ejecting, and when the other nozzle is ejecting while the carriage moves in the return direction, the one nozzle which is adjacent to the other nozzle is not ejecting.

12. A control device for an image forming apparatus comprising a carriage that carries an image forming unit including plural nozzle lines to discharge different color droplets, each nozzle line having multiple nozzles in a nozzle arrangement direction, wherein at least non-adjacent two nozzle lines amongst the plural nozzle lines discharge droplets of same color, and the carriage is configured to reciprocate in a moving direction crossing the nozzle arrangement direction of the nozzles, wherein the control device controls dual-directional printing to form an image using the plural nozzle lines in an outward direction and a return direction of the carriage, and wherein the control device executes color difference handling print control to control the image forming unit to discharge the different color droplets by using, amongst all of the nozzles in the plural nozzle lines, plural nozzles located at different positions in the arrangement direction of the nozzles while not overlapping in the moving direction of the carriage, wherein amongst each pair of adjacent nozzles of respective nozzle lines amongst the plural nozzle lines, one nozzle, amongst the pair of adjacent nozzles and in one nozzle line, is shifted in the nozzle arrangement direction relative to the other nozzle, amongst the pair of adjacent nozzles and in the adjacent nozzle line that is adjacent to the one nozzle line, and the control device selectively controls discharge by the pair of adjacent nozzles of respective nozzle lines such that when the one nozzle is ejecting while the carriage moves in the outward direction, the other nozzle which is adjacent to, and is shifted in the nozzle arrangement direction relative to, the one nozzle is not ejecting, and when the other nozzle is ejecting while the carriage moves in the return direction, the one nozzle which is adjacent to the other nozzle is not ejecting.

13. The control device according to claim 12, wherein the control device selectively uses the nozzles each having a nozzle resolution less than a nozzle resolution N in the color difference handling print control, where the nozzle resolution N represents a resolution obtained when the droplets are discharged with a nozzle distance in the arrangement direction of the nozzles.

14. The control device according to claim 12, wherein the control device determines whether to execute the color difference handling print control depending on a kind of printed images.

15. The control device according to claim 14, wherein the color difference handling print control is executed when the printed images are images or fill image.

16. The control device according to claim 12, wherein the control device determines whether a color causing a color difference is contained in an input image or printed image in the dual-directional printing, and the control device executes the color difference handling print control when the color causing a color difference is contained.

17. The control device according to claim 12, wherein the control device determines whether a color causing a color difference equal to or greater than a value is contained in an input image or printed image in the dual-directional printing and the control device executes the color difference handling print control when the color causing a color difference greater than the value is contained.

18. The control device according to claim 12, wherein the control device separates an input image or a print image into an area including a color causing a color difference in the dual-directional printing and an area including no color causing a color difference therein, and the control device executes the color difference handling print control in the area including the color causing a color difference.

19. The control device according to claim 12, wherein the control device separates an input image or a print image into an area including a color causing a color difference equal to or greater than a value in the dual-directional printing and an area including no color causing a color difference equal to or greater than the value therein, and the control device executes the color difference handling print control in the area including the color causing a color difference equal to or greater than the value.

20. The image forming apparatus according to claim 1, wherein the control device selectively controls discharge such that plural nozzles of at least one nozzle line are not ejecting and plural nozzles of one or more nozzles lines, other than the plural nozzles of the at least one nozzle line that are not ejecting, are ejecting, the plural nozzles of the one or more nozzles lines that are ejecting being located at an identical position in the nozzle arrangement direction to the plural nozzles of the at least one nozzle line that are not ejecting.

* * * * *